US011615758B2

(12) United States Patent
Kondo et al.

(10) Patent No.: US 11,615,758 B2
(45) Date of Patent: Mar. 28, 2023

(54) DISPLAY DRIVER

(71) Applicant: SEIKO EPSON CORPORATION, Tokyo (JP)

(72) Inventors: Daishi Kondo, Chino (JP); Gaku Numano, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/864,689

(22) Filed: Jul. 14, 2022

(65) Prior Publication Data

US 2023/0028092 A1 Jan. 26, 2023

(30) Foreign Application Priority Data

Jul. 21, 2021 (JP) ..... JP2021-120095

(51) Int. Cl.
*G09G 3/36* (2006.01)

(52) U.S. Cl.
CPC ..... *G09G 3/3688* (2013.01); *G09G 3/3614* (2013.01); *G09G 3/3681* (2013.01); *G09G 2310/027* (2013.01); *G09G 2310/0291* (2013.01); *G09G 2310/08* (2013.01); *G09G 2320/02* (2013.01); *G09G 2330/02* (2013.01)

(58) Field of Classification Search
CPC ..... G09G 2330/021; G09G 5/006; G09G 2310/027
See application file for complete search history.

(56) References Cited

U.S. PATENT DOCUMENTS 7,224,218 B1 * 5/2007 Jiang ..... H03F 3/2173 327/132
2004/0155643 A1 * 8/2004 Hidaka ..... H03G 3/3005 324/101
2012/0127356 A1 * 5/2012 Matsuura ..... H04N 5/3577 348/E3.016
2014/0292409 A1 10/2014 Nishimura
2015/0061981 A1 * 3/2015 Lee ..... G09G 3/3291 345/77
2015/0338989 A1 * 11/2015 Noto ..... G06F 3/0412 345/174

FOREIGN PATENT DOCUMENTS

JP 2012-070599 A 4/2012
JP 2014-191012 A 10/2014
JP 2017-097174 A 6/2017

* cited by examiner

*Primary Examiner* — Van N Chow
(74) *Attorney, Agent, or Firm* — Rankin, Hill & Clark LLP

(57) ABSTRACT

A display driver includes a line latch circuit; a first D/A conversion circuit; a second D/A conversion circuit; a first amplifier circuit configured to initialize charges of a capacitor of a first switched capacitor circuit in a first initialization period and output a data voltage in a first output period; a second amplifier circuit configured to initialize charges of a capacitor of a second switched capacitor circuit in a second initialization period and output a data voltage in a second output period; and a control circuit. The control circuit is configured to end the second initialization period of the second amplifier circuit before display data is latched by the line latch circuit at a latch timing and an output of the first amplifier circuit changes.

7 Claims, 13 Drawing Sheets

INITIALIZATION PERIOD

OUTPUT PERIOD

DISPLAY DRIVER

The present application is based on, and claims priority from JP Application Serial Number 2021-120095, filed Jul. 21, 2021, the disclosure of which is hereby incorporated by reference herein in its entirety.

BACKGROUND

1. Technical Field

The present disclosure relates to a display driver and the like.

2. Related Art

A display driver for driving a display panel such as a color liquid crystal panel has been known in the related art. A related-art technique of the display driver includes those disclosed in, for example, JP-A-2017-97174 and JP-A-2014-191012. In the display drivers in JP-A-2017-97174 and JP-A-2014-191012, an initialization operation of initializing a capacitor of an amplifier circuit is performed in an initialization period. Further, in an output period, a data voltage is output by an operational amplifier of the amplifier circuit.

It is found that in the display driver in which the initialization operation of the amplifier circuit is performed as described above, display quality of the display panel may be reduced due to noise caused by a latch operation of display data in a line latch circuit.

SUMMARY

An aspect of the present disclosure relates to a display driver, and the display driver includes: a line latch circuit configured to latch display data of one line; a first D/A conversion circuit configured to perform D/A conversion on the display data from the line latch circuit; a second D/A conversion circuit configured to perform D/A conversion on the display data from the line latch circuit; a first amplifier circuit which includes a first switched capacitor circuit and a first operational amplifier, and in which in a first initialization period, charges of a capacitor of the first switched capacitor circuit are initialized, and in a first output period, the first operational amplifier amplifies an output voltage of the first D/A conversion circuit based on the charges of the capacitor of the first switched capacitor circuit to output a data voltage; a second amplifier circuit which includes a second switched capacitor circuit and a second operational amplifier, and in which in a second initialization period, charges of a capacitor of the second switched capacitor circuit are initialized, and in a second output period, the second operational amplifier amplifies an output voltage of the second D/A conversion circuit based on the charges of the capacitor of the second switched capacitor circuit to output a data voltage; and a control circuit configured to control the line latch circuit, the first amplifier circuit, and the second amplifier circuit. The control circuit is configured to end the second initialization period of the second amplifier circuit before the display data is latched by the line latch circuit at a latch timing and an output of the first amplifier circuit changes.

DESCRIPTION OF EXEMPLARY EMBODIMENTS

Hereinafter, the present embodiment will be described. The present embodiment described below do not unduly limit the scope of the claims. All of the configurations described in the present embodiment are not necessarily essential constituent elements.

1. Display Driver

Figure 1:
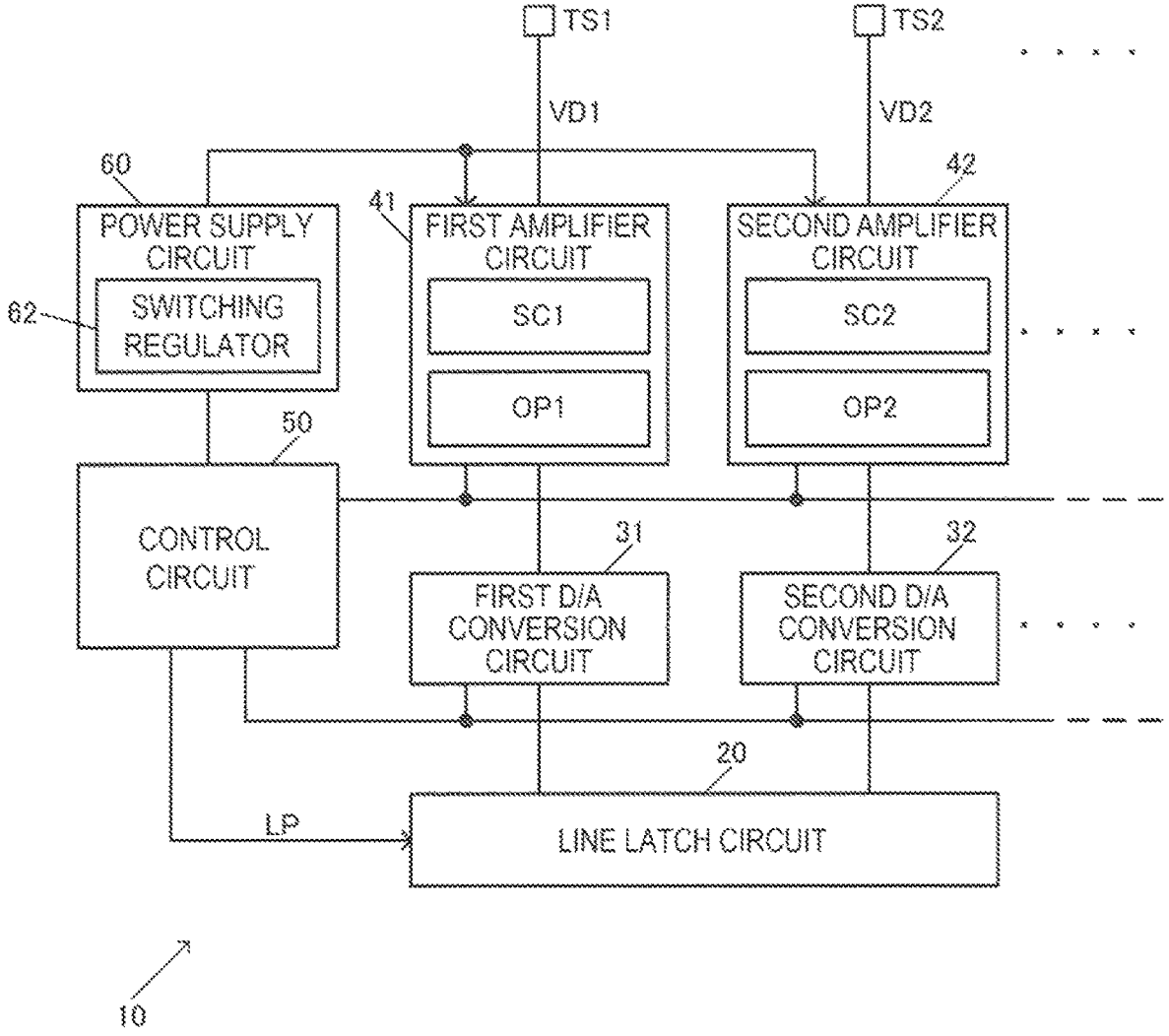
FIG. 1 shows a configuration example of a display driver according to the present embodiment.

FIG. 1 shows a configuration example of a display driver 10 according to the present embodiment. The display driver 10 includes a line latch circuit 20, first D/A conversion circuits 31, second D/A conversion circuits 32, first amplifier circuits 41, second amplifier circuits 42, and a control circuit 50. The display driver 10 may include a power supply circuit 60. The display driver 10 is not limited to the configuration in FIG. 1, and various modifications such as omitting a part of the constituent elements or adding other constituent elements are possible. For example, another circuit block may be provided between the line latch circuit 20 and the first D/A conversion circuit 31 or the second D/A conversion circuit 32, or between the first D/A conversion circuit 31 or the second D/A conversion circuit 32 and the first amplifier circuit 41 or the second amplifier circuit 42.

The line latch circuit 20 is a circuit that latches display data. For example, the line latch circuit 20 latches display data of one line. For example, the line latch circuit 20 latches the display data based on a latch pulse LP from the control circuit 50. The display data of one line is, for example, an amount of display data corresponding to a plurality of source lines to be driven by the display driver 10 in a horizontal scanning period. The line latch circuit 20 may be any circuit as long as display data of at least one line can be latched. The line latch circuit 20 may include a plurality of latches each of which is implemented by a storage circuit such as a flip-flop circuit.

The first D/A conversion circuits 31 and the second D/A conversion circuits 32 perform D/A conversion on the display data from the line latch circuit 20. For example, the first D/A conversion circuit 31 performs D/A conversion on the display data corresponding to a source line driven by the first amplifier circuit 41 which is provided downstream of the first D/A conversion circuit 31. The second D/A conversion circuit 32 performs D/A conversion on the display data corresponding to a source line driven by the second amplifier circuit 42 provided downstream of the second D/A conversion circuit 32. The first D/A conversion circuit 31 and the second D/A conversion circuit 32 output, as output voltages, grayscale voltages selected, based on the display data from the line latch circuit 20, from a plurality of grayscale voltages from a grayscale voltage generation circuit (not shown).

The first amplifier circuit 41 includes a first switched capacitor circuit SC1 and a first operational amplifier OP1. The first switched capacitor circuit SC1 is a circuit including at least one capacitor and at least one switch, and a voltage applied to the capacitor is controlled by turning on and off the switch. The first operational amplifier OP1 includes an inverting input terminal, a non-inverting input terminal, and an output terminal, and for example, at least one of the terminals is coupled to a charge accumulation node of the capacitor of the first switched capacitor circuit SC1. In the first amplifier circuit 41, in a first initialization period TI1 in FIG. 7 to be described later, charges of the capacitor of the first switched capacitor circuit SC1 are initialized. Thus, by initializing the charges accumulated in the capacitor in the first initialization period TI1, for example, an offset variation of the first operational amplifier OP1 can be cancelled. For example, in the first initialization period TI1, by applying a given voltage such as a reference voltage to the capacitor of the first switched capacitor circuit SC1, charges for initialization are accumulated in the capacitor. In the first amplifier circuit 41, in a first output period TQ1, the first operational amplifier OP1 amplifies an output voltage of the first D/A conversion circuit 31 based on the charges of the capacitor of the first switched capacitor circuit SC1, and outputs a data voltage VD1. The first output period TQ1 is a period following the first initialization period TI1. For example, when the output voltage of the first D/A conversion circuit 31 is input to the first amplifier circuit 41 in the first output period TQ1 in a state where the charges are accumulated in the capacitor in the first initialization period TI1, the first operational amplifier OP1 outputs the data voltage VD1 corresponding to the output voltage of the first D/A conversion circuit 31. For example, the data voltage VD1 is a voltage that changes in accordance with the output voltage of the first D/A conversion circuit 31.

The second amplifier circuit 42 includes a second switched capacitor circuit SC2 and a second operational amplifier OP2. The second switched capacitor circuit SC2 is a circuit including at least one capacitor and at least one switch, and a voltage applied to the capacitor is controlled by turning on and off the switch. The second operational amplifier OP2 includes an inverting input terminal, a non-inverting input terminal, and an output terminal, and for example, at least one of the terminals is coupled to a charge accumulation node of the capacitor of the second switched capacitor circuit SC2. In the second amplifier circuit 42, in a second initialization period TI2 in FIG. 7, charges of the capacitor of the second switched capacitor circuit SC2 are initialized. Thus, by initializing the charges accumulated in the capacitor in the second initialization period TI2, for example, an offset variation of the second operational amplifier OP2 can be cancelled. For example, in the second initialization period TI2, by applying a given voltage such as a reference voltage to the capacitor of the second switched capacitor circuit SC2, charges for initialization are accumulated in the capacitor. In the second amplifier circuit 42, in the second output period TQ2, the second operational amplifier OP2 amplifies an output voltage of the second D/A conversion circuit 32 based on the charges of the capacitor of the second switched capacitor circuit SC2, and outputs a data voltage VD2. The second output period TQ2 is a period following the second initialization period TI2. For example, when the output voltage of the second D/A conversion circuit 32 is input to the second amplifier circuit 42 in the second output period TQ2 in a state where the charges are accumulated in the capacitor in the second initialization period TI2, the second operational amplifier OP2 outputs the data voltage VD2 corresponding to the output voltage of the second D/A conversion circuit 32. For example, the data voltage VD2 is a voltage that changes in accordance with the output voltage of the second D/A conversion circuit 32.

The control circuit 50 controls the line latch circuit 20, the first amplifier circuit 41, and the second amplifier circuit 42. The control circuit 50 also controls other circuit blocks of the display driver 10, such as the power supply circuit 60. For example, the control circuit 50 outputs the latch pulse LP to the line latch circuit 20 to control a latch operation of the line latch circuit 20. In addition, the control circuit 50 outputs control signals such as switch control signals to the first amplifier circuit 41 and the second amplifier circuit 42 to control switched capacitor operations of the first switched capacitor circuit SC1 and the second switched capacitor circuit SC2. The control circuit 50 is, for example, a logic circuit, and is, for example, a circuit implemented by automatic placement and routing such as a gate array.

As described in FIG. 7 to be described later, the control circuit 50 ends the second initialization period TI2 of the second amplifier circuit 42 before the display data is latched by the line latch circuit 20 at a latch timing and an output of the first amplifier circuit 41 changes. For example, at a latch timing tm of the line latch circuit 20 based on the latch pulse LP from the control circuit 50, the display data of the line latch circuit 20 changes, so that the output voltage of the first D/A conversion circuit 31 changes, and thus the output of the first amplifier circuit 41 also changes. Then, the control circuit 50 ends the second initialization period TI2 of the second amplifier circuit 42 before the latch timing tm of the line latch circuit 20 in order to prevent the change in the output of the first amplifier circuit 41 from adversely affecting an initialization operation of the second amplifier circuit 42 in the second initialization period TI2. Specifically, the control circuit 50 performs control to end the second initialization period 112 using, for example, a control signal for an initialization operation of the second amplifier circuit 42.

Thus, it is possible to prevent the noise caused by the change in the output of the first amplifier circuit 41 due to the latch of the display data in the line latch circuit 20 from adversely affecting the initialization operation of the second amplifier circuit 42. For example, it is possible to prevent a situation in which the voltage such as the reference voltage applied to the capacitor of the second switched capacitor circuit SC2 in the second initialization period 112 of the second amplifier circuit 42 fluctuates due to the noise caused by the change in the output of the first amplifier circuit 41, and the charges accumulated in the capacitor fluctuate.

Similarly, the control circuit 50 ends the first initialization period TI1 of the first amplifier circuit 41 before the display data is latched by the line latch circuit 20 at a latch timing and the output of the second amplifier circuit 42 changes. For example, at the latch timing tm of the line latch circuit 20 based on the latch pulse LP from the control circuit 50, the display data of the line latch circuit 20 changes, so that the output voltage of the second D/A conversion circuit 32 also changes, and thus the output of the second amplifier circuit 42 also changes. Then, the control circuit 50 ends the first initialization period TI1 of the first amplifier circuit 41 before the latch timing tm of the line latch circuit 20 in order to prevent the change in the output of the second amplifier circuit 42 from adversely affecting an initialization operation of the first amplifier circuit 41 in the first initialization period TI1. Specifically, the control circuit 50 performs control to end the first initialization period TI1 using, for example, a control signal for the initialization operation of the first amplifier circuit 41.

Thus, it is possible to prevent the noise caused by the change in the output of the second amplifier circuit 42 due to the latch of the display data in the line latch circuit 20 from adversely affecting the initialization operation of the first amplifier circuit 41. For example, it is possible to prevent a situation in which the voltage such as the reference voltage applied to the capacitor of the first switched capacitor circuit SC1 in the first initialization period TI1 of the first amplifier circuit 41 fluctuates due to the noise caused by the change in the output of the second amplifier circuit 42, and the charges accumulated in the capacitor fluctuate.

The power supply circuit 60 includes a switching regulator 62, and supplies power supply voltages to the first amplifier circuit 41 and the second amplifier circuit 42. The power supply circuit 60 also supplies power supply voltages to circuit blocks other than the first amplifier circuit 41 and the second amplifier circuit 42. The switching regulator 62 of the power supply circuit 60 performs a switching regulation operation for boosting a voltage based on the power supply voltages, and the power supply voltages based on the voltage generated by the switching regulation operation are supplied to the first amplifier circuit 41 and the second amplifier circuit 42. The power supply voltages supplied to the first amplifier circuit 41 and the second amplifier circuit 42 may be different power supply voltages or may be the same power supply voltage. The switching regulator 62 is, for example, a DC-DC converter that converts an input voltage into an output voltage different from the input voltage by performing a switching regulation operation using an inductor or the like. The inductor may be an external component of the display driver 10 or may be built in the display driver 10.

Figure 7:
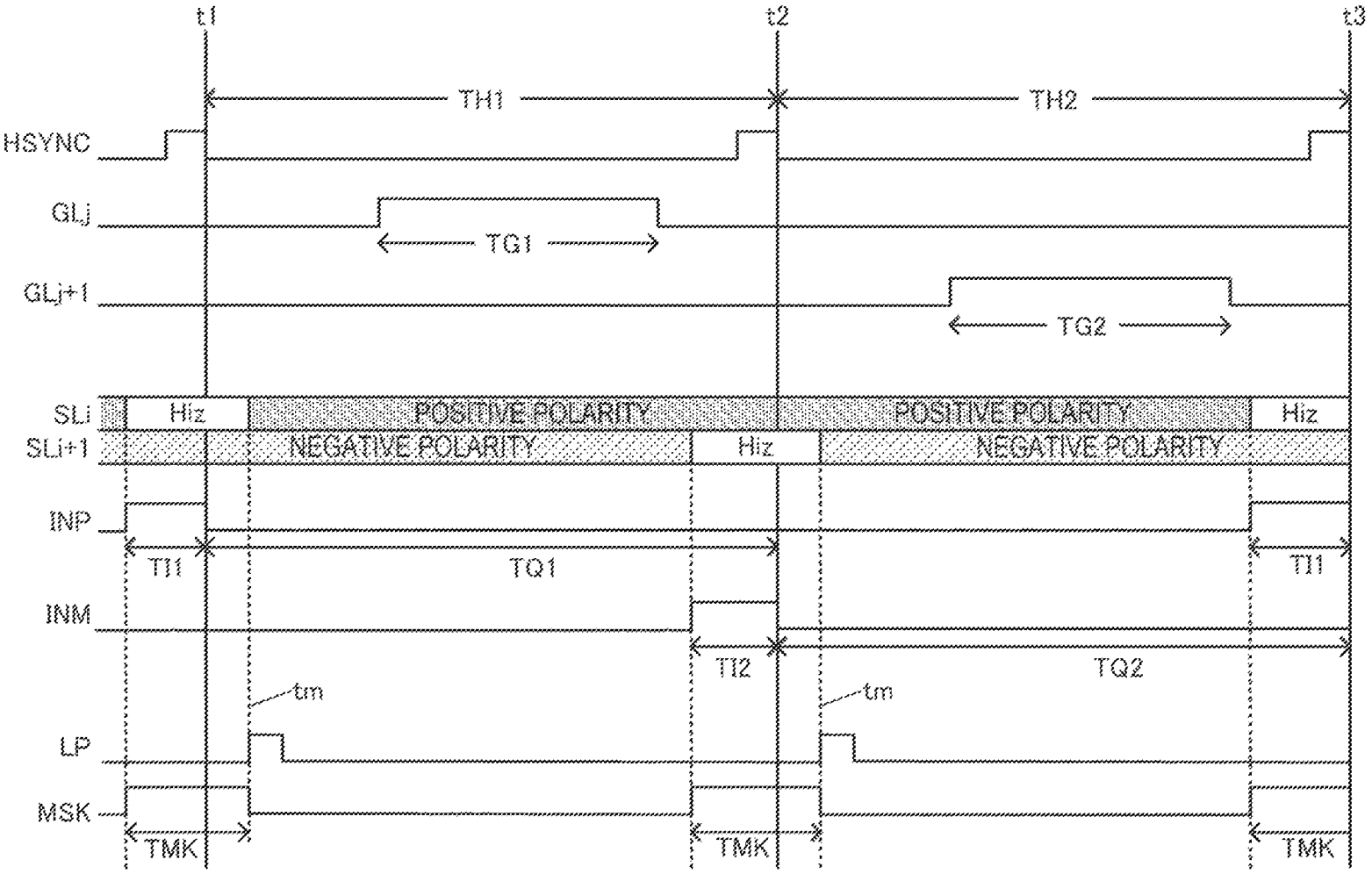
FIG. 7 is a signal waveform diagram illustrating an operation of the present embodiment.

As shown in FIG. 7 to be described later, the control circuit 50 stops the operation of the switching regulator 62 at least in the second initialization period TI2. For example, in the second initialization period TI2 of the second amplifier circuit 42, the control circuit 50 outputs a mask signal MSK which is a control signal for disabling the operation of the switching regulator 62, to stop the operation of the switching regulator 62. That is, when the mask signal MSK is at an active level in a mask period TMK in FIG. 7, the operation of the switching regulator 62 is stopped in the second initialization period TI2.

Thus, it is possible to prevent the noise caused by the switching regulation operation of the switching regulator 62 from adversely affecting the initialization operation of the second amplifier circuit 42 in the second initialization period TI2. For example, it is possible to prevent a situation in which the voltage such as the reference voltage applied to the capacitor of the second switched capacitor circuit SC2 in the second initialization period TI2 of the second amplifier circuit 42 fluctuates due to the noise caused by the switching regulation operation, and the charges accumulated in the capacitor fluctuate.

The control circuit 50 also stops the operation of the switching regulator 62, for example, in the first initialization period TI1. For example, in the first initialization period TI1 of the first amplifier circuit 41, the control circuit 50 outputs the mask signal MSK which is a control signal for disabling the operation of the switching regulator 62, and stops the operation of the switching regulator 62. That is, when the mask signal MSK is at the active level in the mask period TMK in FIG. 7, the operation of the switching regulator 62 is stopped in the first initialization period TI1.

Thus, it is possible to prevent the noise caused by the switching regulation operation of the switching regulator 62 from adversely affecting the initialization operation of the first amplifier circuit 41 in the first initialization period TI1. For example, it is possible to prevent a situation in which the voltage such as the reference voltage applied to the capacitor of the first switched capacitor circuit SC1 in the first initialization period TI1 of the first amplifier circuit 41 fluctuates due to the noise caused by the switching regulation operation, and the charges accumulated in the capacitor fluctuate.

Figure 2:
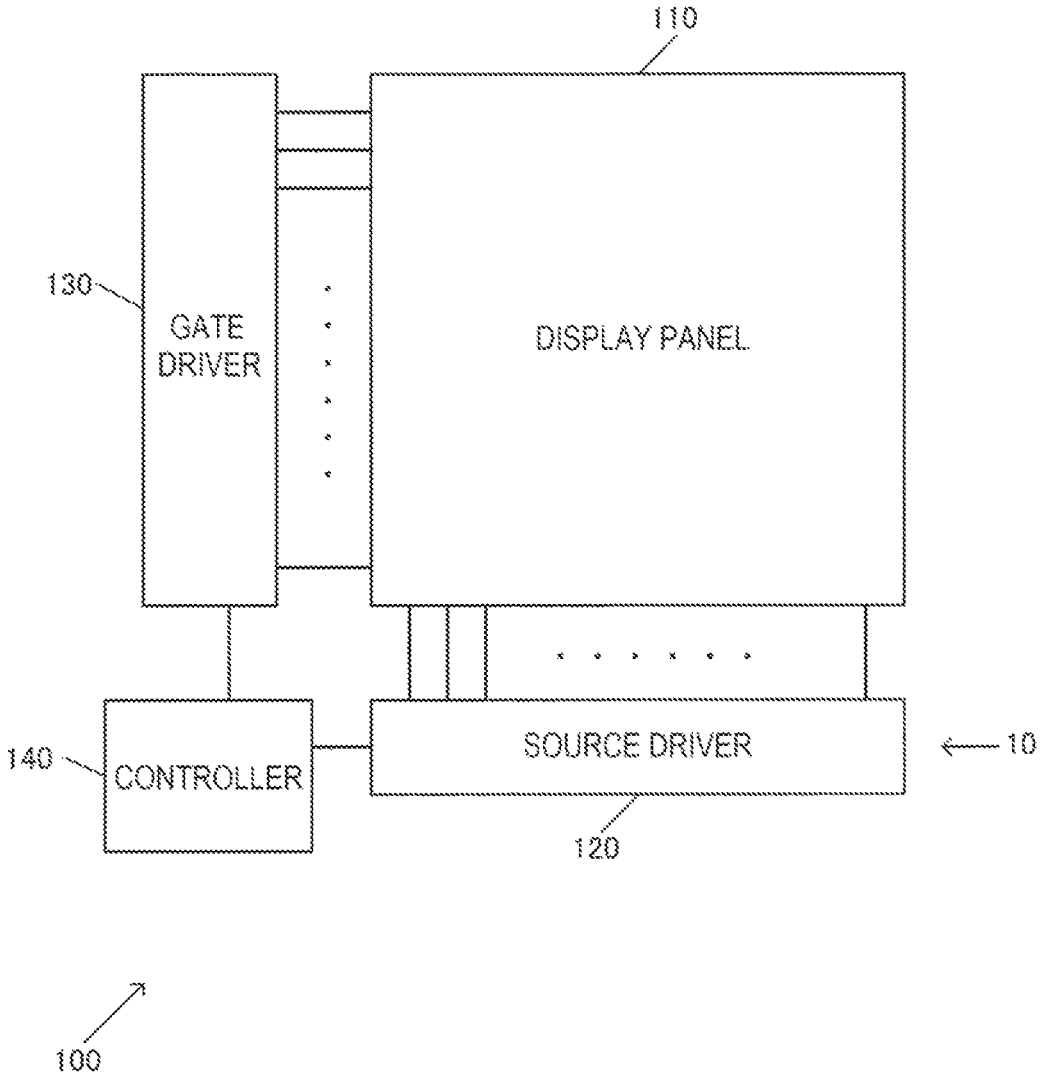
FIG. 2 shows a configuration example of an electro-optical device including the display driver.

FIG. 2 shows a configuration example of an electro-optical device 100 including the display driver 10 according to the present embodiment. The display driver 10 includes a source driver 120 that drives a plurality of source lines of a display panel 110. The display driver 10 may also include a gate driver 130 that drives a plurality of gate lines of the display panel 110. The electro-optical device 100 includes the display driver 10 and the display panel 110. Further, the electro-optical device 100 may include a controller 140.

The display panel 110 is, for example, a liquid crystal panel. For example, the display panel 110 is an active matrix type TFT liquid crystal panel. The display panel 110 includes the plurality of source lines, the plurality of gate lines, and a plurality of pixels each being provided corresponding to an intersection position of each source line and each gate line. The source driver 120 outputs a data voltage to the plurality of source lines of the display panel 110, and the gate driver 130 performs gate line selection to sequentially select the plurality of gate lines of the display panel 110. The source lines correspond to data lines, the gate lines correspond to scanning lines, and the gate line selection corresponds to scanning line selection.

Figure 3:
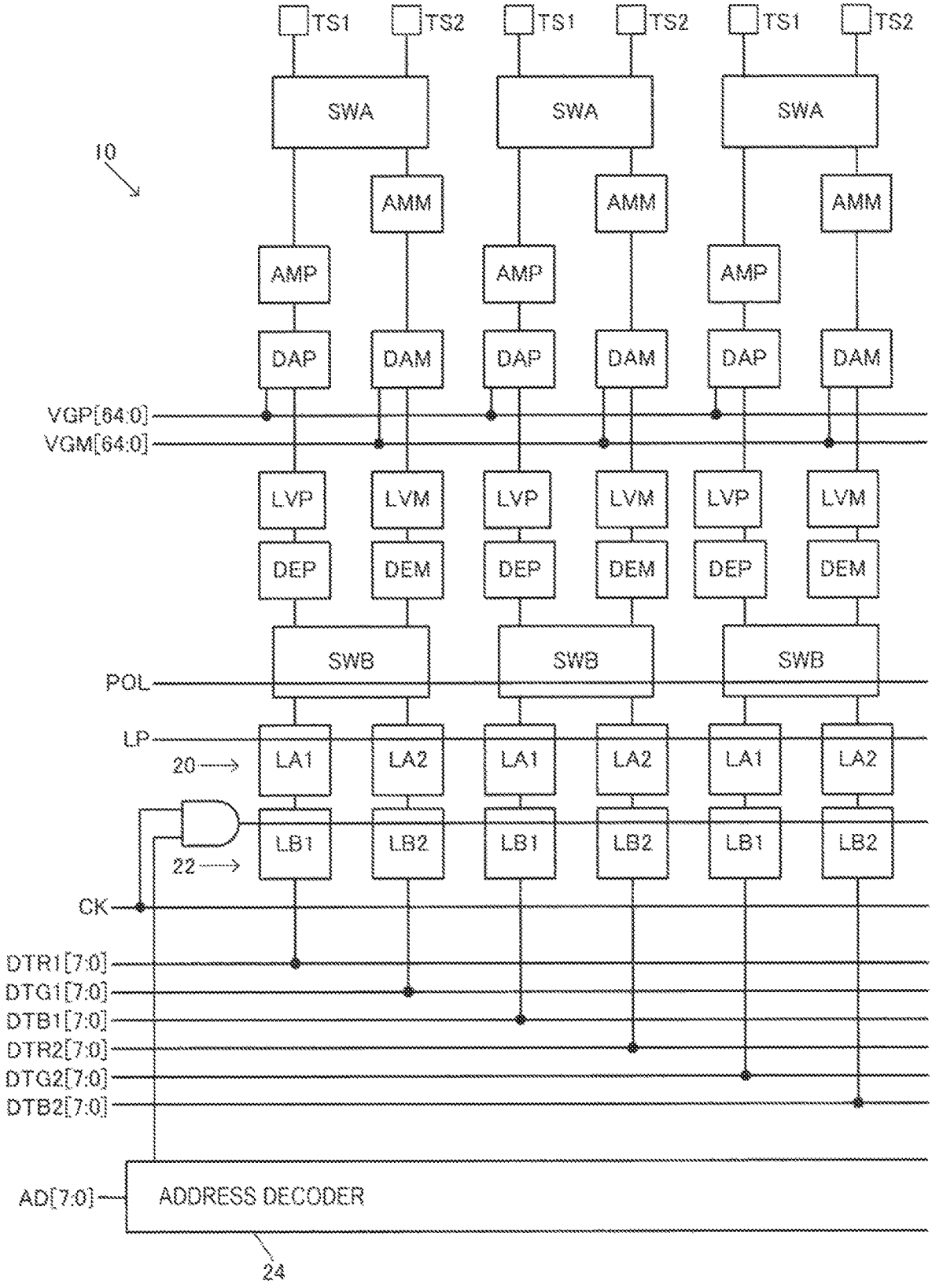
FIG. 3 shows a detailed configuration example of the display driver according to the present embodiment.

FIG. 3 shows a detailed configuration example of the display driver 10 according to the present embodiment. In FIG. 3, an input latch circuit 22 is provided upstream of the line latch circuit 20. The input latch circuit 22 includes a plurality of latches LB1 and LB2. The input latch circuit 22 receives display data DTR1, DTG1, DTB1, DTR2, DTG2, and DTB2, and latches the display data based on a latch signal based on a clock signal CK and a decoding signal from an address decoder 24 that decodes an address AD. DTR1, DTG1, and DTB1 are 8-bit display data of R, G, and B of a first pixel, respectively. DTR2, DTG2, and DTB2 are 8-bit display data of R, G, and B of a second pixel, respectively.

The display data latched by the input latch circuit 22 is latched by the line latch circuit 20 based on the latch pulse LP. The line latch circuit 20 includes a plurality of latches LA1 and LA2. A switch circuit SWB performs a replacement processing on the display data such that the display data from the latches LA1 and LA2 is respectively output to conversion circuits DEP and DEM in a Nth frame, and the display data from the latches LA1 and LA2 is respectively output to the conversion circuits DEM and DEP in a (N+1)th frame. That is, the switch circuit SWB performs the replacement processing on the display data based on a polarity signal POL. The display data from the conversion circuits DEP and DEM is subjected to a voltage level shift by level shifters LVP and LVM, and is input to D/A conversion circuits DAP and DAM.

The positive D/A conversion circuit DAP outputs, as an output voltage, a grayscale voltage selected from a positive grayscale voltage VGP based on the display data to a positive amplifier circuit AMP. The negative D/A conversion circuit DAM outputs, as an output voltage, a grayscale voltage selected from a negative grayscale voltage VGM based on the display data to a negative amplifier circuit AMM. For example, the amplifier circuit AMP in FIG. 3 corresponds to the first amplifier circuit 41 in FIG. 1, and the amplifier circuit AMM corresponds to the second amplifier circuit 42, or vice versa. The D/A conversion circuit DAP in FIG. 3 corresponds to the first D/A conversion circuit 31 in FIG. 1, and the D/A conversion circuit DAM corresponds to the second D/A conversion circuit 32, or vice versa.

In the Nth frame, a switch circuit SWA outputs a data voltage from the positive amplifier circuit AMP to a terminal TS1, and outputs a data voltage from the negative amplifier circuit AMM to a terminal TS2. In the (N+1)th frame, the switch circuit SWA outputs the data voltage from the negative amplifier circuit AMM to the terminal TS1, and outputs the data voltage from the positive amplifier circuit AMP to the terminal TS2.

Figure 4:
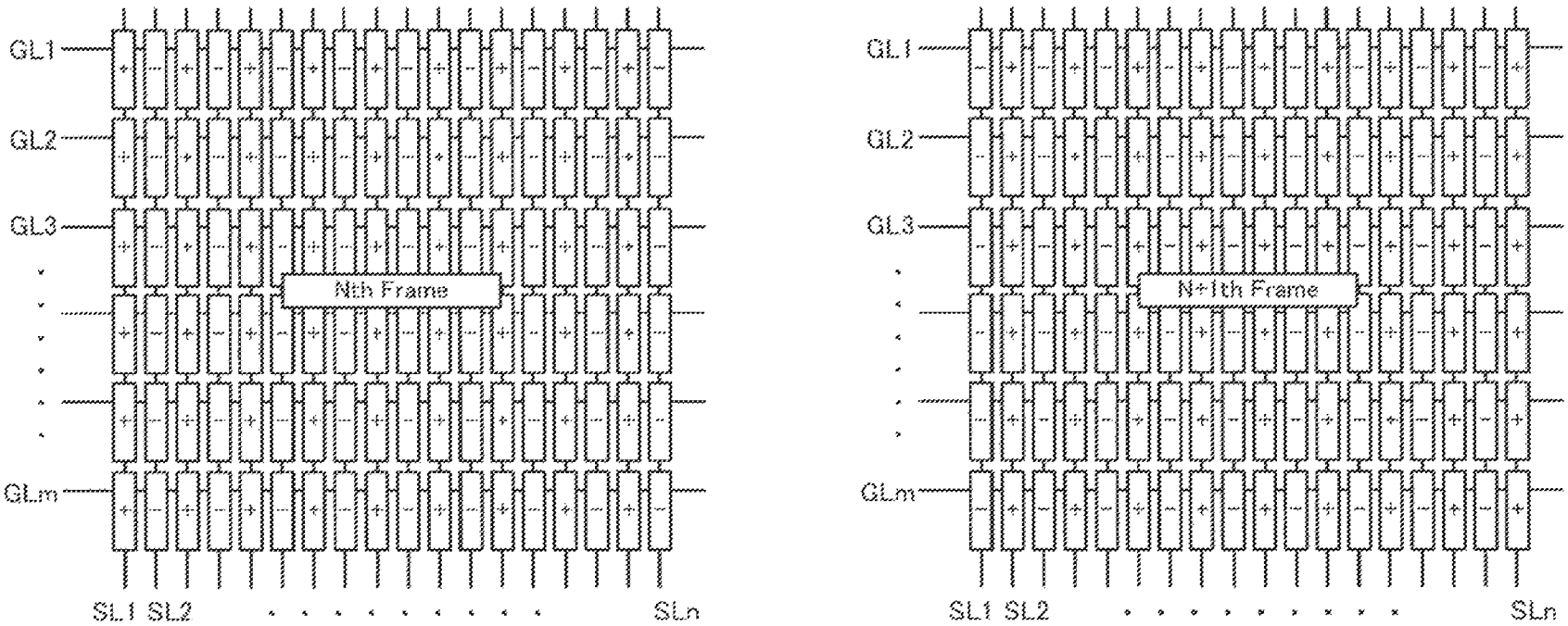
FIG. 4 is a diagram illustrating column inversion.

As shown in FIG. 3, for each frame, the display data is replaced by the switch circuit SWB and the positive and negative data voltages are replaced by the switch circuit SWA, and thus column inversion driving of the display driver 10 as shown in FIG. 4 is implemented. In FIG. 4, SL1 to SLn are the source lines and correspond to the data lines, and GL1 to GLm are the gate lines and correspond to the scanning lines. For example, in FIG. 4, in the Nth frame, the odd-numbered source lines are driven with the positive polarity, and the even-numbered source lines are driven with the negative polarity. Being driven with the positive polarity means, for example, being driven with a positive data voltage, and being driven with the negative polarity means, for example, being driven with a negative data voltage. In the (N+1)th frame, the odd-numbered source lines are driven with the negative polarity, and the even-numbered source lines are driven with the positive polarity. Thus, in FIG. 4, the column inversion driving is performed.

Figure 5:
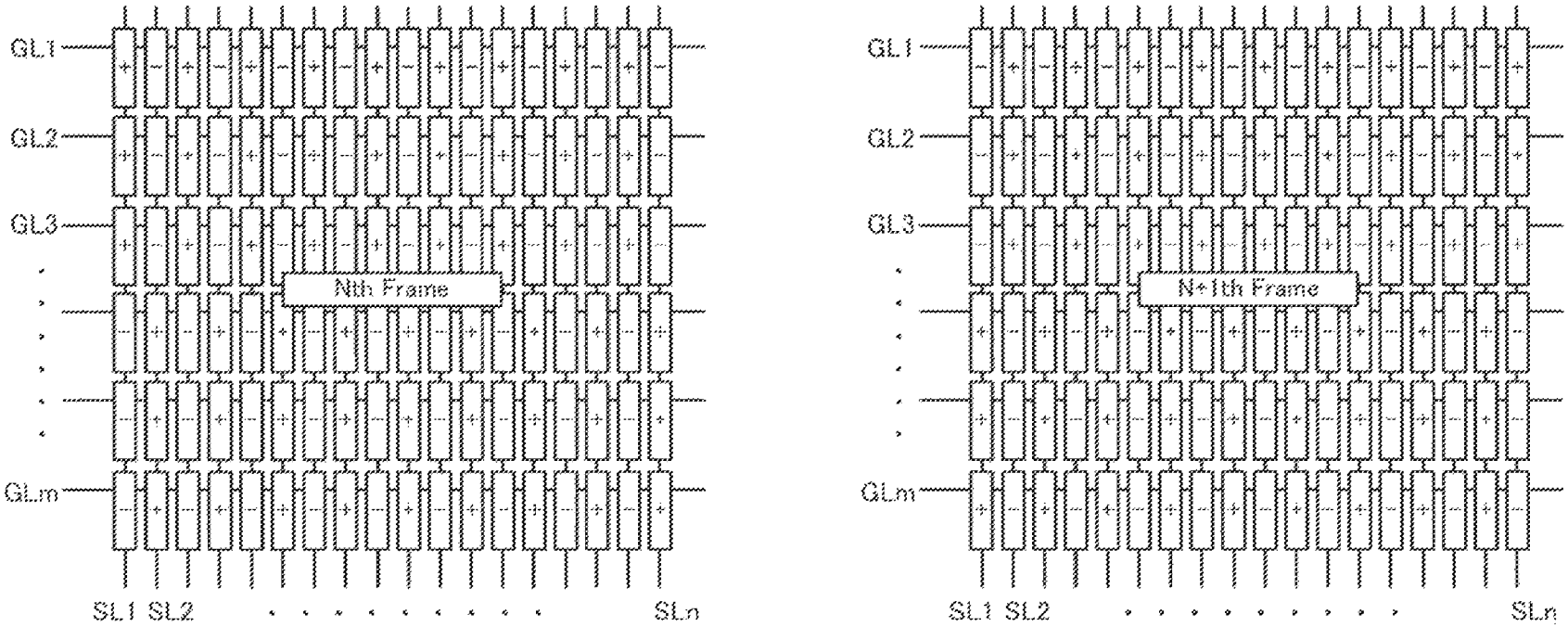
FIG. 5 is a diagram illustrating 3-dot inversion.

As described above, in the present embodiment, the first amplifier circuit 41 is the positive amplifier circuit AMP that outputs a positive voltage, and the second amplifier circuit 42 is the negative amplifier circuit AMM that outputs a negative voltage. Thus, the inversion driving of the display driver 10 can be implemented by positive driving of the positive amplifier circuit AMP and negative driving of the negative amplifier circuit AMM. Specifically, for example, inversion driving such as column inversion driving as shown in FIG. 4 can be implemented. The inversion driving of the display driver 10 is not limited to such column inversion driving, and may be inversion driving for each of a plurality of dots, such as 3-dot inversion driving shown in FIG. 5. For example, in FIG. 5, pixels corresponding to intersections of the source line SL1 with the gate lines GL1, GL2, and GL3 are driven with the positive polarity in the Nth frame, and are driven with the negative polarity in the (N+1)th frame. Pixels corresponding to intersections of the source line SL2 with the gate lines GL1, GL2, and GL3 are driven with the negative polarity in the Nth frame, and are driven with the positive polarity in the (N+1)th frame. On the other hand, pixels corresponding to intersections of the source line SL1 with the gate lines GL4, GL5, and GL6 are driven with the negative polarity in the Nth frame, and are driven with the positive polarity in the (N+1)th frame. Pixels corresponding to intersections of the source line SL2 with the gate lines GL4, GL5, and GL6 are driven with the positive polarity in the Nth frame, and are driven with the negative polarity in the (N+1)th frame.

2. Operation

Figure 6:
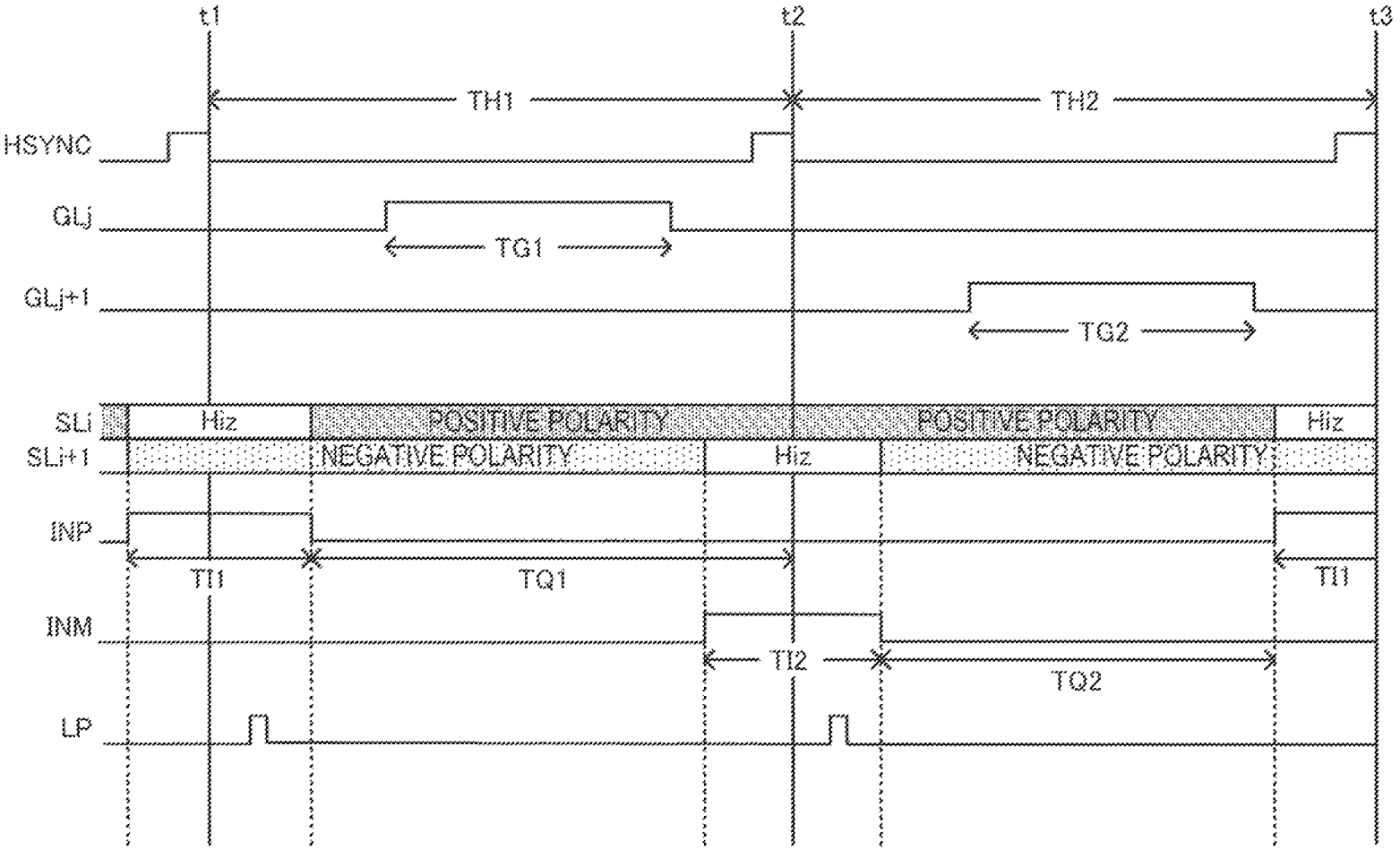
FIG. 6 is a signal waveform diagram illustrating an operation of a comparative example.

Next, detailed operations of the display driver 10 according to the present embodiment will be described. First, operations of a comparative example of the present embodiment will be described with reference to FIG. 6. In FIG. 6, in the first initialization period TI1, the source line SLi is in a high impedance state, and the initialization operation of the first amplifier circuit 41 is performed. In the second initialization period TI2, the source line SLi+1 adjacent to the source line SLi is in the high impedance state, and the initialization operation of the second amplifier circuit 42 is performed.

In the comparative example in FIG. 6, in the first initialization period TI1, the latch pulse LP is active, and the display data is latched by the line latch circuit 20. In the second initialization period TI2, the latch pulse LP is also active, and the display data is also latched by the line latch circuit 20.

In this case, for example, when the display data is latched by the line latch circuit 20 in the second initialization period TI2, the display data is output to the first D/A conversion circuit 31, and the output voltage of the first D/A conversion circuit 31 is output to the first amplifier circuit 41, so that the output of the first amplifier circuit 41 changes. Thus, the noise caused by the change in the output of the first amplifier circuit 41 adversely affects the second amplifier circuit 42 performing the initialization operation in the second initialization period TI2, and the display quality is reduced. For example, a situation occurs in which noise caused by the change in the output of the first amplifier circuit 41 is superimposed on the voltage such as a reference voltage, which will be described later, applied to the capacitor of the second switched capacitor circuit SC2 of the second amplifier circuit 42 for initialization operation. Accordingly, the charges accumulated in the capacitor of the second switched capacitor circuit SC2 fluctuate, the data voltage output by the second amplifier circuit 42 in the second output period TQ2 fluctuates, and thereby the display quality of a display image on the display panel 110 is reduced.

Similarly, for example, when the display data is latched by the line latch circuit 20 in the first initialization period TI1, the display data is output to the second D/A conversion circuit 32, and the output voltage of the second D/A conversion circuit 32 is output to the second amplifier circuit 42, so that the output of the second amplifier circuit 42 changes. Thus, the noise caused by the change in the output of the second amplifier circuit adversely affects the first amplifier circuit 41 performing the initialization operation in the first initialization period TI1, and the display quality is reduced. For example, a situation occurs in which the noise caused by the change in the output of the second amplifier circuit 42 is superimposed on the voltage such as a reference voltage, which will be described later, applied to the capacitor of the first switched capacitor circuit SC1 of the first amplifier circuit 41 for the initialization operation. Accordingly, the charges accumulated in the capacitor of the first switched capacitor circuit SC1 fluctuate, the data voltage output by the first amplifier circuit 41 in the first output period TQ1 fluctuates, and thereby the display quality of the display image on the display panel 110 is reduced.

For example, in the case where column inversion driving is performed as shown in FIG. 4, when the display data is latched by the line latch circuit 20 while the even-numbered second amplifier circuits 42 coupled to the even-numbered source line are performing the initialization operation, the outputs of the odd-numbered first amplifier circuits 41 coupled to the odd-numbered source line change. Thus, the noise caused by the change in the outputs of the odd-numbered first amplifier circuits 41 is transmitted to the power supply circuit 60, and the voltage such as the reference voltage supplied from the power supply circuit 60 to the second amplifier circuit 42 fluctuates. Accordingly, the charges accumulated in the capacitors of the second switched capacitor circuits SC2 of the even-numbered second amplifier circuits 42 in the second initialization period TI2 fluctuate, the data voltage output by the second amplifier circuit 42 in the second output period TQ2 fluctuates, and the display quality is reduced. For example, a situation occurs in which a lateral stripe of two lines is generated in the display panel 110.

Similarly, when the display data is latched by the line latch circuit 20 while the odd-numbered first amplifier circuits 41 are performing the initialization operation, the outputs of the even-numbered second amplifier circuits 42 change. Thus, the noise caused by the change in the outputs of the even-numbered second amplifier circuits 42 is transmitted to the power supply circuit 60, and the voltage such as the reference voltage supplied from the power supply circuit 60 to the first amplifier circuit 41 fluctuates. Accordingly, the charges accumulated in the capacitors of the first switched capacitor circuits SC1 of the odd-numbered first amplifier circuits 41 in the first initialization period TI1 fluctuate, the data voltage output by the first amplifier circuit 41 in the first output period TQ1 fluctuates, and the display quality is reduced.

Therefore, in the present embodiment, a method of ending the initialization period before the display data is latched by the line latch circuit 20 at the latch timing is adopted. FIG. 7 is a signal waveform diagram showing the operations of the present embodiment.

In FIG. 7, a period between a timing t1 and a timing t2 is a first horizontal scanning period TH1, and a period between the timing t2 and a timing t3 is a second horizontal scanning period TH2. In the first horizontal scanning period TH1, a gate line GLj is in a selected state in a first gate line selection period TG1, and the data voltage is written to the corresponding pixel. In the second horizontal scanning period TH2, a gate line GLj+1 is in the selected state in a second gate line selection period TG2, and the data voltage is written to the corresponding pixel. The first gate line selection period TG1 and the second gate line selection period TG2 correspond to a first scanning line selection period and a second scanning line selection period, respectively.

In the first initialization period TI1, the source line SLi is in the high impedance state. For example, the output of the first amplifier circuit 41 that drives the source line SLi is in the high impedance state. The high impedance state is implemented by turning off an output switch provided at an output node of the first amplifier circuit 41. Then, for example, the initialization operation of the first amplifier circuit 41 is performed in the first initialization period TI1 based on a first initialization signal INP from the control circuit 50. That is, in the first initialization period TI1, the charges accumulated in the capacitor of the first switched capacitor circuit SC1 of the first amplifier circuit 41 are initialized. Then, in the first output period TQ1 after the first initialization period TI1, the source line SLi is driven with the positive polarity. That is, the first amplifier circuit 41 drives the source line SLi with the positive voltage. The first amplifier circuit 41 also drives the source line SLi with the positive polarity in the second horizontal scanning period TH2 after the first horizontal scanning period TH1.

In the second initialization period TI2, the source line SLi+1 adjacent to the source line SLi is in the high impedance state. For example, the output of the second amplifier circuit 42 that drives the source line SLi+1 is in the high impedance state. The high impedance state is implemented by turning off an output switch provided at an output node of the second amplifier circuit 42. Then, for example, the initialization operation of the second amplifier circuit 42 is performed in the second initialization period TI2 based on a second initialization signal INM from the control circuit 50. That is, in the second initialization period TI2, the charges accumulated in the capacitor of the second switched capacitor circuit SC2 of the second amplifier circuit 42 are initialized. Then, in the second output period TQ2 after the second initialization period TI2, the source line SLi+1 is driven with the negative polarity. That is, the second amplifier circuit 42 drives the source line SLi+1 with the negative voltage. The second amplifier circuit 42 also drives the source line SLi with the negative polarity in the horizontal scanning period after the second horizontal scanning period TH2.

As shown in FIG. 7, in the present embodiment, the second initialization period 112 of the second amplifier circuit 42 is ended before the latch timing tm at which the display data is latched by the line latch circuit 20. Similarly, the first initialization period TI1 of the first amplifier circuit 41 is ended before the latch timing tm at which the display data is latched by the line latch circuit 20.

For example, in the comparative example in FIG. 6, in the second initialization period 112 of the second amplifier circuit 42, the display data is latched by the line latch circuit 20, and therefore, the noise caused by the change in the output of the first amplifier circuit 41 due to the latch of the display data adversely affects the initialization operation of the second amplifier circuit 42, and the display quality is reduced. In contrast, in the present embodiment, the second initialization period 112 of the second amplifier circuit 42 is ended before the latch timing tm at which the display data is latched by the line latch circuit 20. Therefore, since the initialization operation of the second amplifier circuit 42 is ended at the latch timing tm of the display data, it is possible to prevent the noise caused by the change in the output of the first amplifier circuit 41 due to the latch of the display data from adversely affecting the initialization operation of the second amplifier circuit 42, and it is possible to improve the display quality. In the comparative example in FIG. 6, since the display data is latched by the line latch circuit 20 in the first initialization period TI1 of the first amplifier circuit 41, the noise caused by the change in the output of the second amplifier circuit 42 due to the latch of the display data adversely affects the initialization operation of the first amplifier circuit 41, and the display quality is reduced. In contrast, in the present embodiment, the first initialization period TI1 of the first amplifier circuit 41 is ended before the latch timing tm at which the display data is latched by the line latch circuit 20. Therefore, since the initialization operation of the first amplifier circuit 41 is ended at the latch timing tm of the display data, it is possible to prevent the noise caused by the change in the output of the second amplifier circuit 42 due to the latch of the display data from adversely affecting the initialization operation of the first amplifier circuit 41, and it is possible to improve the display quality.

As shown in FIG. 1, the display driver 10 includes the power supply circuit 60 that includes the switching regulator 62 and that supplies power supply voltages to the first amplifier circuit 41 and the second amplifier circuit 42. The control circuit 50 stops the operation of the switching regulator 62 at least in the second initialization period TI2. Specifically, as shown in FIG. 7, the control circuit 50 sets the mask signal MSK to an active level, which is a high level, in the second initialization period TI2. Thus, when the mask signal MSK is at the active level, the operation of the switching regulator 62 is stopped. Accordingly, it is possible to prevent the noise caused by the switching regulation operation of the switching regulator 62 from adversely affecting the initialization operation of the second amplifier circuit 42, and it is possible to prevent the display quality from being reduced due to the noise. Similarly, the control circuit 50 stops the operation of the switching regulator 62 at least in the first initialization period TI1. Specifically, as shown in FIG. 7, the control circuit 50 stops the operation of the switching regulator 62 by setting the mask signal MSK to the active level in the first initialization period TI1. Accordingly, it is possible to prevent the noise caused by the switching regulation operation of the switching regulator 62 from adversely affecting the initialization operation of the first amplifier circuit 41, and it is possible to prevent the display quality from being reduced due to the noise. The operation of the switching regulator may be stopped at least in the first initialization period TI1 and the second initialization period TI2. For example, in FIG. 7, the mask period TMK during which the operation of the switching regulator 62 is stopped is longer than the first initialization period TI1 and the second initialization period TI2. Even when the operation of the switching regulator 62 is stopped, a voltage regulated by the switching regulation operation is held and output.

In the present embodiment, as shown in FIG. 7, the control circuit 50 alternately performs, for each horizontal scanning period, the initialization operation of the first amplifier circuit 41 in the first initialization period TI1 and the initialization operation of the second amplifier circuit 42 in the second initialization period TI2. For example, in FIG. 7, every time the horizontal scanning period is switched from the first horizontal scanning period TH1 to the second horizontal scanning period TH2, the initialization operation of the first amplifier circuit 41 in the first initialization period TI1 and the initialization operation of the second amplifier circuit 42 in the second initialization period 112 are alternately performed. For example, when the initialization operations of both the first amplifier circuit 41 and the second amplifier circuit 42 are performed in the same initialization period, a defect such as a reduction in display quality may occur due to a variation in the power supply voltage or the like. In this regard, the occurrence of such a defect can be prevented by alternately performing, for each horizontal scanning period, the initialization operation of the first amplifier circuit 41 and the initialization operation of the second amplifier circuit 42 as shown in FIG. 7. In FIG. 7, the initialization operation of the first amplifier circuit 41 is performed before the timing t1 at which the first horizontal scanning period TH1 starts, and the initialization operation of the second amplifier circuit 42 is performed before the timing t2 at which the second horizontal scanning period TH2 starts.

In the present embodiment, as shown in FIG. 7, the control circuit 50 performs the initialization operation of the second amplifier circuit 42 in the second initialization period 112 after the first gate line selection period TG1 in the first horizontal scanning period TH1. Then, the control circuit 50 ends the second initialization period 112 of the second amplifier circuit 42 before the display data is latched by the line latch circuit 20 at the latch timing tm and the output of the first amplifier circuit 41 changes. The control circuit 50 performs the initialization operation of the first amplifier circuit 41 in the first initialization period TI1 after the second gate line selection period TG2 in the second horizontal scanning period TH2. Then, the control circuit 50 ends the first initialization period TI1 of the first amplifier circuit 41 before the display data is latched by the line latch circuit at the latch timing tm and the output of the second amplifier circuit 42 changes.

Thus, after the data voltage is written to the pixel selected in the first gate line selection period TG1 of the first horizontal scanning period TH1, the initialization operation of the second amplifier circuit 42 can be performed in the second initialization period TI2. Then, the display data is latched by the line latch circuit 20 at the latch timing tm after the second initialization period TI2, so that it is possible to prevent the noise caused by the change in the output of the first amplifier circuit 41 due to the latch of the display data from adversely affecting the initialization operation of the second amplifier circuit 42. After the display data is latched by the line latch circuit 20 at the latch timing tm, the data voltage is written to the pixel selected in the second gate line selection period TG2 of the second horizontal scanning period TH2, and the initialization operation of the first amplifier circuit 41 can be performed in the subsequent first initialization period TI1. The display data is latched by the line latch circuit 20 at the latch timing tm after the first initialization period TI1, so that it is possible to prevent the noise caused by the change in the output of the second amplifier circuit 42 due to the latch of the display data from adversely affecting the initialization operation of the first amplifier circuit 41.

In the present embodiment, as shown in FIG. 7, the control circuit 50 ends the second initialization period 112 before the scanning period is switched from the first horizontal scanning period TH1 to the second horizontal scanning period TH2. After the scanning period is switched from the first horizontal scanning period TH1 to the second horizontal scanning period TH2, the control circuit 50 causes the line latch circuit 20 to perform the latch operation in the second horizontal scanning period TH2. That is, the initialization operation of the second amplifier circuit 42 is ended by the timing t2 at which the horizontal scanning period is switched from the first horizontal scanning period TH1 to the second horizontal scanning period TH2. After the timing t2 at which the horizontal scanning period is switched, the line latch circuit 20 performs the latch operation. Similarly, the initialization operation of the first amplifier circuit 41 is ended by the timing t1 at which the horizontal scanning period is switched. After the timing t1 at which the horizontal scanning period is switched, the line latch circuit 20 performs the latch operation. Thus, it is possible to end the latch operation of the line latch circuit 20 as soon as possible, write the data voltage to the pixel in the subsequent second gate line selection period TG2 and the first gate line selection period TG1, and lengthen writing time of the data voltage.

For example, in the comparative example in FIG. 6, when the timing of the latch pulse LP is merely delayed to be after the initialization operation, the writing time of the data voltage is shortened by the delay of the timing of the latch pulse LP. When the writing time of the data voltage is shortened as described above, the data voltage cannot be suitably written in the pixel, which leads to a reduction in image quality.

In this regard, in FIG. 7, the initialization operation of each amplifier circuit is ended before the timings t1 and t2 at which the horizontal scanning period is switched, and the line latch circuit 20 performs the latch operation after the timings t1 and t2. That is, the initialization operation of each amplifier circuit is performed in a horizontal scanning period before the horizontal scanning period in which each amplifier circuit outputs the data voltage. Thus, it is possible to lengthen the writing time of the data voltage while preventing the noise caused by the latch of the display data by the line latch circuit 20 from adversely affecting the initialization operation, and it is possible to improve the display quality of the display panel 110.

3. Amplifier Circuit and Power Supply Circuit

Next, a detailed configuration example and operations of each of the first amplifier circuit 41 and the second amplifier circuit 42 will be described with reference to FIGS. 8 to 10.

Figure 8:
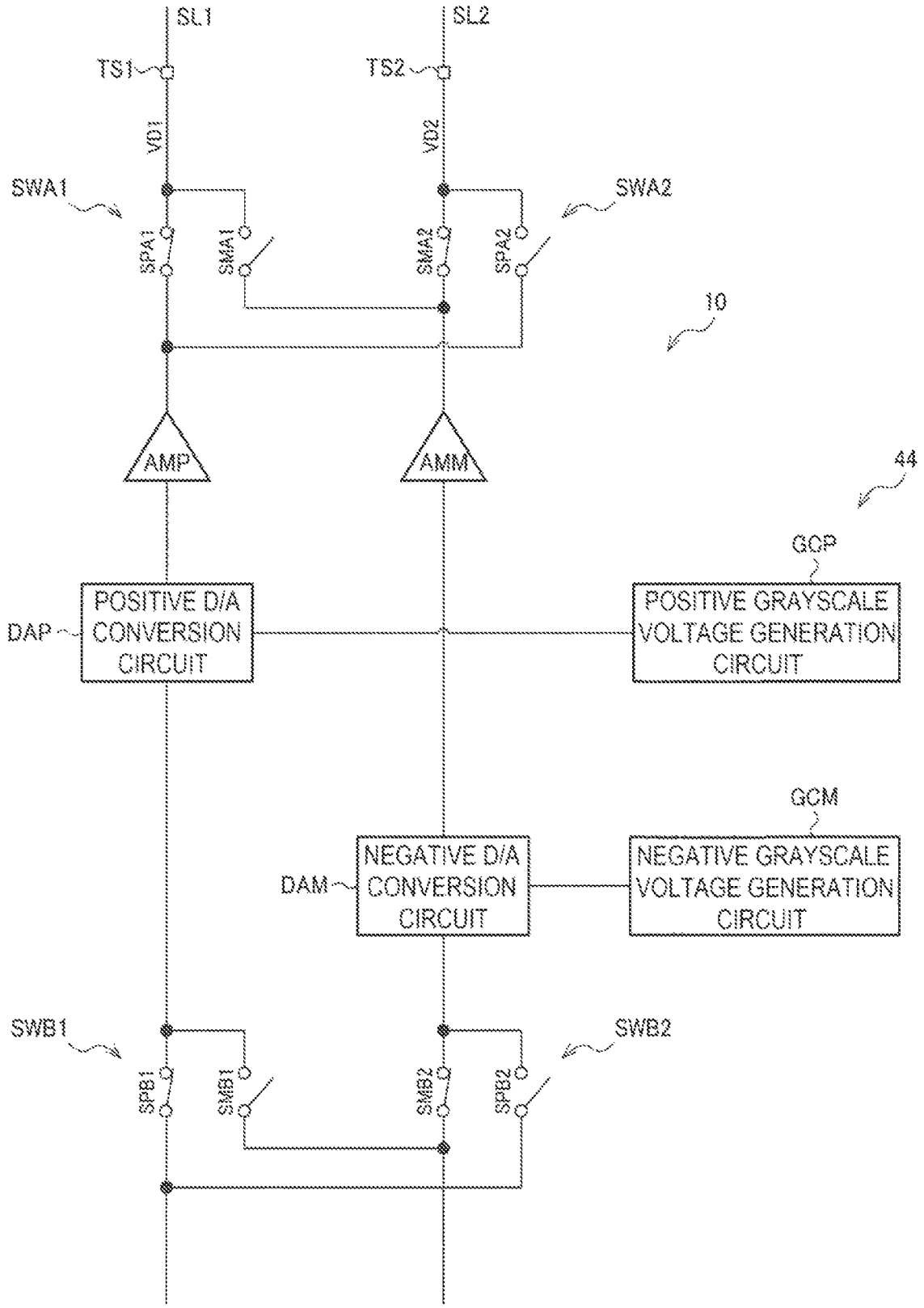
FIG. 8 is a diagram illustrating a switching operation of a positive amplifier circuit and a negative amplifier circuit.

In FIG. 8, the display driver 10 is provided with switch circuits SWA1 and SWA2, a positive amplifier circuit AMP, a negative amplifier circuit AMM, a positive D/A conversion circuit DAP, a negative D/A conversion circuit DAM, switch circuits SWB1 and SWB2, and a grayscale voltage generation circuit 44. The positive amplifier circuit AMP and the positive D/A conversion circuit DAP correspond to, for example, the first amplifier circuit 41 and the first D/A conversion circuit 31, respectively. The negative amplifier circuit AMM and the negative D/A conversion circuit DAM correspond to, for example, the second amplifier circuit 42 and the second D/A conversion circuit 32, respectively. The switch circuit SWA1 includes switches SPAT and SMA1, and the switch circuit SWA2 includes switches SPA2 and SPA2. The switch circuit SWB1 includes switches SPB1 and SMB1, and the switch circuit SWB2 includes switches SMB2 and SPB2. The grayscale voltage generation circuit 44 includes a positive grayscale voltage generation circuit GCP that outputs a plurality of positive grayscale voltages and a negative grayscale voltage generation circuit GCM that outputs a plurality of negative grayscale voltages.

In a first state in which the source lines SL1 and SL2 coupled to the terminals TS1 and TS2 are driven with the positive polarity and the negative polarity, respectively, the switches SPAT, SMA2, SPB1, and SMB2 are turned on. In this case, the positive D/A conversion circuit DAP selects a voltage corresponding to the display data for the source line SL1 from the plurality of positive grayscale voltages. The positive amplifier circuit AMP drives the source line SL1 with the positive data voltage VD1 based on the selected voltage. On the other hand, the negative D/A conversion circuit DAM selects a voltage corresponding to the display data for the source line SL2 from the plurality of negative grayscale voltages. The negative amplifier circuit AMM drives the source line SL2 with the negative data voltage VD2 based on the selected voltage.

On the other hand, in a second state in which the source lines SL1 and SL2 are driven with the negative polarity and the positive polarity, respectively, the switches SMA1, SPA2, SMB1, and SPB2 are turned on. In this case, the negative D/A conversion circuit DAM selects a voltage corresponding to the display data for the source line SL1 from the plurality of negative grayscale voltages. The negative amplifier circuit AMM drives the source line SL1 with the negative data voltage VD1 based on the selected voltage. On the other hand, the positive D/A conversion circuit DAP selects a voltage corresponding to the display data for the source line SL2 from the plurality of positive grayscale voltages. The positive amplifier circuit AMP drives the source line SL2 with the positive data voltage VD2 based on the selected voltage.

Next, the configuration and operations of the positive amplifier circuit AMP will be described with reference to FIGS. 9 and 10. As shown in FIG. 9, the positive amplifier circuit AMP includes the first operational amplifier OP1 and the first switched capacitor circuit SC1 including capacitors CIA and CFA and switches SA1 to SA5. The positive amplifier circuit AMP is a circuit that receives an output voltage VDAP of the positive D/A conversion circuit DAP, outputs the data voltage VD1, and drives the data line. The output voltage VDAP of the D/A conversion circuit DAP is, for example, 0 V to +6 V.

The capacitor CIA is provided between a node NA1 and a summing node NEGA coupled to the inverting input terminal of the first operational amplifier OP1. The inverting input terminal is a first input terminal. The capacitor CFA is provided between the summing node NEGA and a node NA2. Each of the capacitors CIA and CFA includes, for example, a plurality of unit capacitors.

The switch SA1 is provided between an input node NIA of the positive amplifier circuit AMP and the node NA1. The switch SA2 is provided between an input node of a reference voltage VDDRMP and the node NA1. The switch SA3 is provided between the node NA2 and an output node NQA. The switch SA4 is provided between the node NA2 and the input node of the reference voltage VDDRMP. The switch SA5 is provided between the summing node NEGA and the output node NQA. The switches SA1 to SA5 include, for example, CMOS transistors, and specifically include transfer gates including P-type transistors and N-type transistors. The transistors are turned on or off according to the switch control signals output by the control circuit 50. The reference voltage VDDRMP is, for example, a voltage between VDD, which is a high-potential-side power supply voltage, and VSS, which is a low-potential-side power supply voltage. VDD is, for example, +6 V, and VSS is, for example, 0 V. For example, VDDRMP=(VDD+VSS)/2, and VDDRMP=+3 V.

In the first operational amplifier OP1, the summing node NEGA is coupled to the inverting input terminal, the reference voltage VDDRMP is input to the non-inverting input terminal, and the data voltage VD1 is output to the output node NQA. The non-inverting input terminal is a second input terminal. A high-potential-side power supply of the first operational amplifier OP1 is, for example, +6 V, and a low-potential-side power supply thereof is, for example, 0 V.

Figure 9:
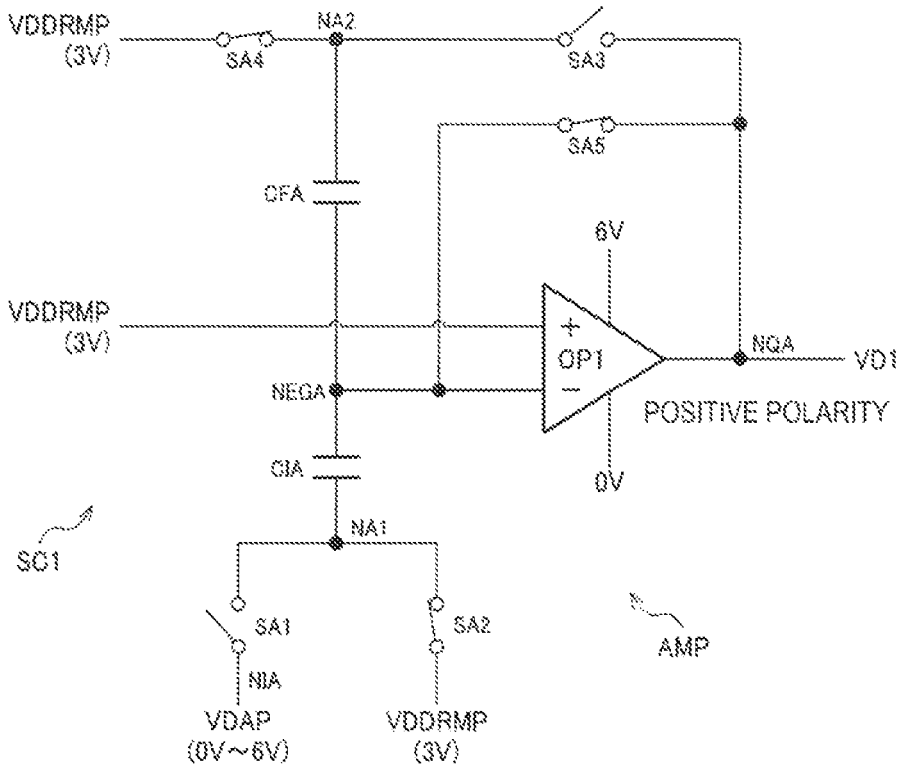
FIG. 9 is a diagram illustrating an operation in a configuration example of the amplifier circuit.

As shown in FIG. 9, in the positive amplifier circuit AMP, the switches SA2, SA4, and SA5 are turned on in the initialization period. When the switch SA2 is turned on in the initialization period, one end of the capacitor CIA, the other end of which is electrically coupled to the summing node NEGA, is set to the reference voltage VDDRMP. Similarly, when the switch SA4 is turned on, one end of the capacitor CFA, the other end of which is electrically coupled to the summing node NEGA, is set to the reference voltage VDDRMP. When the switch SA5, which is a feedback switch, is turned on, the output of the first operational amplifier OP1 is fed back to the inverting input terminal, and the summing node NEGA is set to VDDRMP by an imaginary short function of the first operational amplifier OP1. Accordingly, in the initialization period, the data voltage VD1 is the same voltage as the reference voltage VDDRMP.

Figure 10:
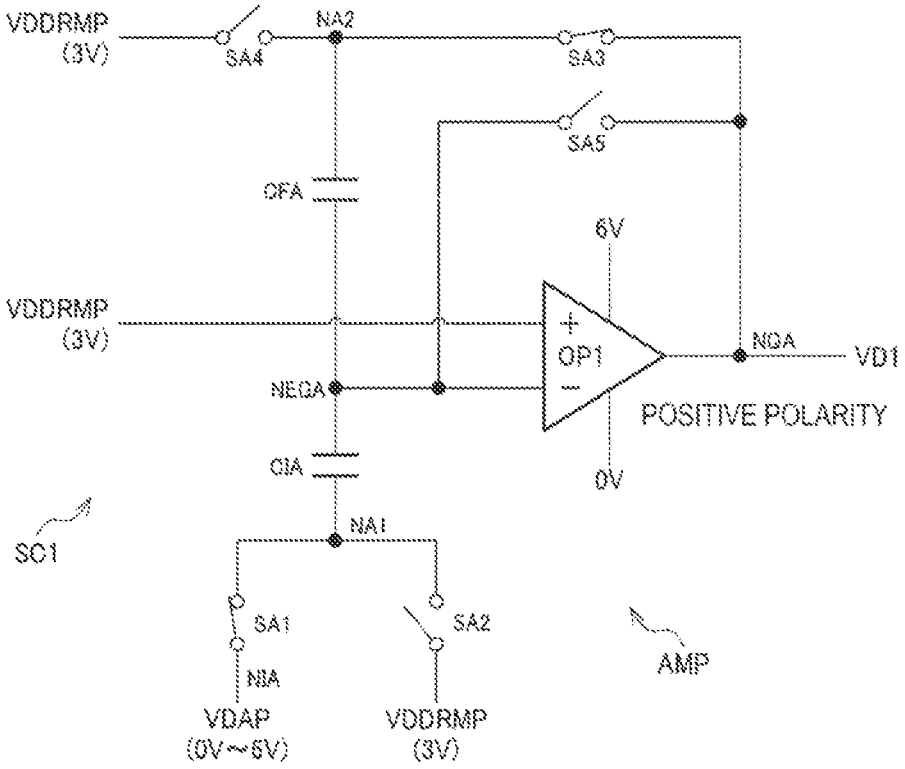
FIG. 10 is a diagram illustrating an operation in the configuration example of the amplifier circuit.

As shown in FIG. 10, in the positive amplifier circuit AMP, the switches SA1 and SA3 are turned on in the output period. When the switch SA1 is turned on in the output period, one end of the capacitor CIA, the other end of which is coupled to the summing node NEGA, is set to VDAP. When the switch SA3 is turned on, one end of the capacitor CFA, the other end of which is coupled to the summing node NEGA, is set to the data voltage VD1. Accordingly, in the output period, the data voltage VD1 is a voltage represented by the following equation (1). In the following equation (1) and equation (2) to be described later, CCIA is capacitance of the capacitor CIA, and CCFA is capacitance of the capacitor CFA.

$$VD1=VDDRMP-(CCIA/CCFA)\times(VDAP-VDDRMP) \quad (1)$$

Figure 11:
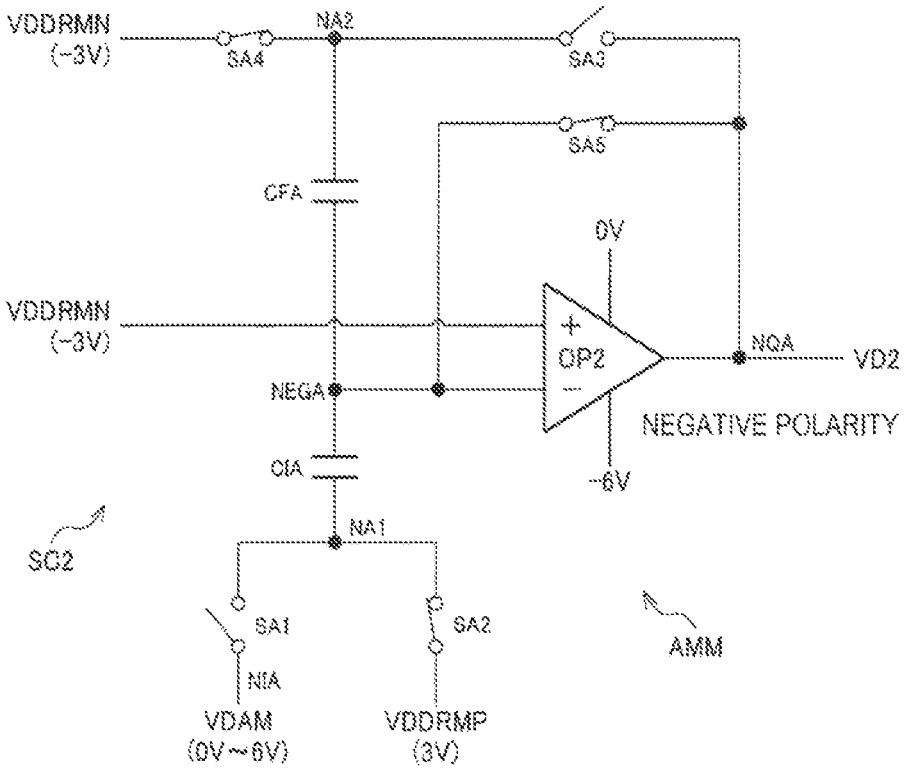
FIG. 11 is a diagram illustrating an operation in a configuration example of the amplifier circuit.
Figure 12:
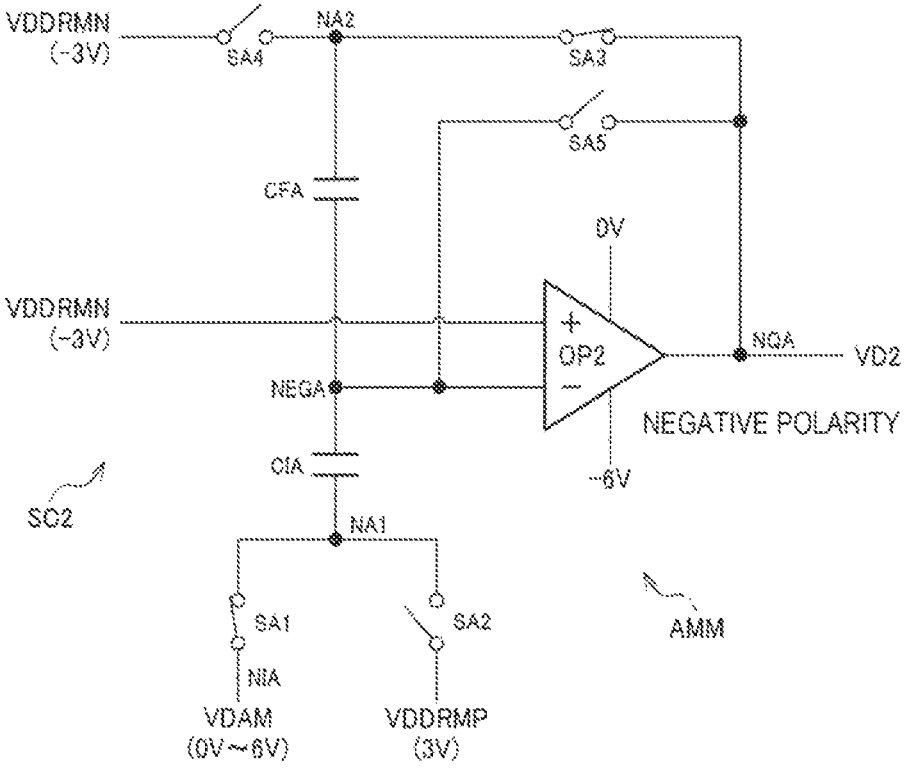
FIG. 12 is a diagram illustrating an operation in the configuration example of the amplifier circuit.

Next, a configuration and operations of the negative amplifier circuit AMM will be described with reference to FIGS. 11 and 12. As shown in FIG. 11, the negative amplifier circuit AMM includes the second operational amplifier OP2 and the second switched capacitor circuit SC2 including the capacitors CIA and CFA and the switches SA1 to SA5. As shown in FIGS. 11 and 12, the configuration and the operations of the negative amplifier circuit AMM are the same as those of the positive amplifier circuit AMP. In the negative amplifier circuit AMM, a reference voltage VDDRMN is also input as the reference voltage. VDDRMN is, for example, −3 V. An output voltage VDAM of the negative D/A conversion circuit DAM is input to the negative amplifier circuit AMM, and the output voltage VDAM is, for example, 0 V to 6 V. A high-potential-side power supply of the second operational amplifier OP2 is, for example, 0 V, and a low-potential-side power supply thereof is, for example, −6 V. Accordingly, in the initialization period, the data voltage VD2 is the same voltage as a second reference power supply VDDRMN, and in the output period, the data voltage VD2 is a voltage represented by the following equation (2).

$$VD2=VDDRMN-(CCIA/CCFA)\times(VDAM-VDDRMP) \quad (2)$$

The positive amplifier circuit AMP in FIGS. 9 and 10 corresponds to, for example, the first amplifier circuit 41 in FIG. 1, and includes the first operational amplifier OP1 and the first switched capacitor circuit SC1 including the capacitors CIA and CFA and the switches SA1 to SA5. In the first initialization period TI1 in FIG. 7, charges of the capacitors CIA and CFA of the first switched capacitor circuit SC1 are initialized. For example, by setting the reference voltage VDDRMP to one end and the other end of each of the capacitors CIA and CFA, the charges accumulated in the capacitors CIA and CFA are initialized. In the first output period TQ1, the first operational amplifier OP1 amplifies the output voltage VDAP of the positive D/A conversion circuit DAP corresponding to the first D/A conversion circuit 31, based on the charges of the capacitors CIA and CFA of the first switched capacitor circuit SC1, and outputs the data voltage VD1. For example, as shown in the above equation (1), the data voltage VD1 represented as VD1=VDDRMP−(CCIA/CCFA)×(VDAP−VDDRMP) is output.

The negative amplifier circuit AMM in FIGS. 11 and 12 corresponds to, for example, the second amplifier circuit 42 in FIG. 1, and includes the second operational amplifier OP2 and the second switched capacitor circuit SC2 including the capacitors CIA and CFA and the switches SA1 to SA5. In the second initialization period TI2 in FIG. 7, the charges of the capacitors CIA and CFA of the second switched capacitor circuit SC2 are initialized. For example, by setting the reference voltage VDDRMP or the reference voltage VDDRMN to one end and the other end of each of the capacitors CIA and CFA, the charges accumulated in the capacitors CIA and CFA are initialized. In the second output period TQ2, the second operational amplifier OP2 amplifies the output voltage VDAM of the negative D/A conversion circuit DAM corresponding to the second D/A conversion circuit 32 based on the charges of the capacitors CIA and CFA of the second switched capacitor circuit SC2, and outputs the data voltage VD2. For example, as shown in the above equation (2), the data voltage VD2 represented as VD2=VDDRMN−(CCIA/CCFA)×(VDAM−VDDRMP) is output.

Thus, the capacitors CIA and CFA of the first switched capacitor circuit SC1 and the second switched capacitor circuit SC2 are capacitors to be initialized by application of the reference voltages VDDRMP and VDDRMN. For example, as shown in FIG. 9, in the first initialization period TI1, by applying the reference voltage VDDRMP to one end and the other end of each of the capacitors CIA and CFA of the first switched capacitor circuit SC1, the accumulated charges are initialized. As shown in FIG. 11, in the second initialization period TI2, by applying the reference voltage VDDRMP to one end of the capacitor CIA of the second switched capacitor circuit SC2 and applying the reference voltage VDDRMN to the other end of the capacitor CIA of the second switched capacitor circuit SC2, the accumulated charges are initialized. In the second initialization period TI2, by applying the reference voltage VDDRMN to one end and the other end of the capacitor CFA of the second switched capacitor circuit SC2, the accumulated charges are initialized. Thus, the charges accumulated in the capacitors CIA and CFA can be initialized using the reference voltages VDDRMP and VDDRMN which are constant voltages of stable potentials. Accordingly, in the output period, it is possible to output an appropriate data voltage set based on the charges accumulated in the capacitors CIA and CFA in the initialization period. For example, it is possible to output an appropriate data voltage in which offset voltages and the like of the first operational amplifier OP1 and the second operational amplifier OP2 are cancelled.

For example, when the latch operation of the display data performed by the line latch circuit 20 is performed in the initialization period as in the comparative example in FIG. 6, noise occurs in the reference voltages VDDRMP and VDDRMN used for the initialization operation of the capacitors CIA and CFA. Accordingly, the charges accumulated in the capacitors CIA and CFA fluctuate, which leads to a problem of reduction in display quality. In this regard, in the present embodiment, the initialization period of each amplifier circuit is ended before the latch timing of the display data in the line latch circuit 20. Therefore, it is possible to effectively prevent the reduction in display quality caused by the noise generated in the reference voltages VDDRMP and VDDRMN.

Figure 13:
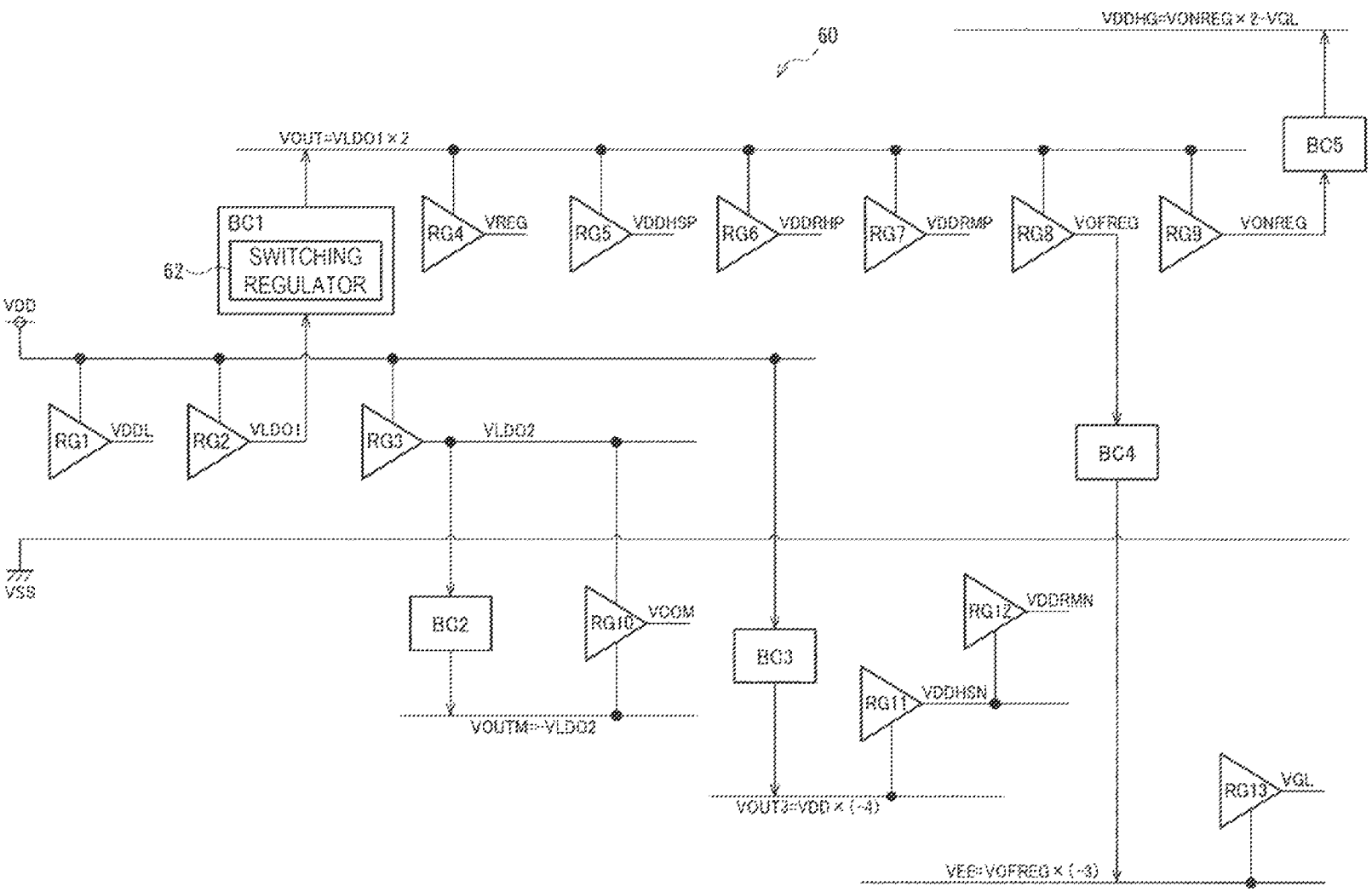
FIG. 13 shows a configuration example of a power supply circuit.

FIG. 13 shows a detailed configuration example of the power supply circuit 60. The power supply circuit 60 includes booster circuits BC1 to BC5 and regulators RG1 to RG13. For example, the booster circuit BC1 is a circuit that boosts the voltage by a switching regulation operation, and the booster circuits BC2 to BC5 are charge pump circuits. The regulators RG1 to RG13 are linear regulators. In FIG. 13, positional relations between the voltages in the vertical direction in the drawing represents an approximate magnitude relation between the voltages. For example, VDDL and VLDOs are voltages between VDD and VSS. VOUTM and VOUT3 are voltages lower than VSS, and are, for example, negative voltages. VOUT is a voltage higher than VDD.

The regulators RG1, RG2, and RG3 step down VDD to generate VDDL, VLDO1, and VLDO2. VDDL is a power supply voltage of the control circuit 50 which is a logic circuit.

The booster circuit BC1 boosts VLDO1 twice with reference to VSS to generate VOUT. The regulators RG4, RG5, RG6, RG7, RG8, and RG9 step down VOUT to generate VREG, VDDHSP, VDDRHP, VDDRMP, VOFREG, and VONREG. The regulator RG4 generates VREG with reference to an output voltage of a bandgap circuit (not shown). Other regulators RG1 to RG3 and RG5 to RG13 output the voltages with reference to VREG. VDDHSP and VDDRMP are voltages used for positive polarity driving. For example, VDDHSP is the power supply voltage of the first positive operational amplifier OP1, and VDDRMP is the reference voltage described above. VDDRHP is a power supply voltage of the grayscale voltage generation circuit.

The booster circuit BC2 inverts VLDO2 with reference to VSS to generate VOUTM which is a negative voltage. The regulator RG10 generates VCOM from VLDO2 and VOUTM. VCOM is a common voltage of the display panel 110. The booster circuit BC3 inverts and boosts VDD four times with reference to VSS to generate VOUT3 which is a negative voltage. The regulator RG11 steps down VOUT3 to generate VDDHSN, and the regulator RG12 steps down VDDHSN to generate VDDRMN. VDDHSN and VDDRMN are voltages used for negative polarity driving. For example, VDDHSN is the power supply voltage of the negative second operational amplifier OP2, and VDDRMN is the reference voltage described above.

The booster circuit BC4 inverts and boosts VOFREG three times with reference to VSS to generate VEE which is a negative voltage. VEE is a substrate voltage of, for example, a P-type semiconductor substrate of the display driver 10. The regulator RG13 steps down the VEE to generate VGL. VGL is a negative power supply voltage of the gate driver 130. The booster circuit BC5 generates VDDHG=VONREG×2−VGL from VONREG and VGL. VDDHG is a positive power supply voltage of the gate driver 130.

The switching regulator 62 described with reference to FIG. 1 is provided in the booster circuit BC1, for example, as shown in FIG. 13. In the present embodiment, as described with reference to FIG. 7, the operation of the switching regulator 62 is stopped in the first initialization period TI1 and the second initialization period TI2. Thus, it is possible to prevent the noise caused by the switching regulation operation of the switching regulator 62 from adversely affecting the initialization operation of the first amplifier circuit 41 in the first initialization period TI1 and the initialization operation of the second amplifier circuit 42 in the second initialization period TI2.

Figure 14:
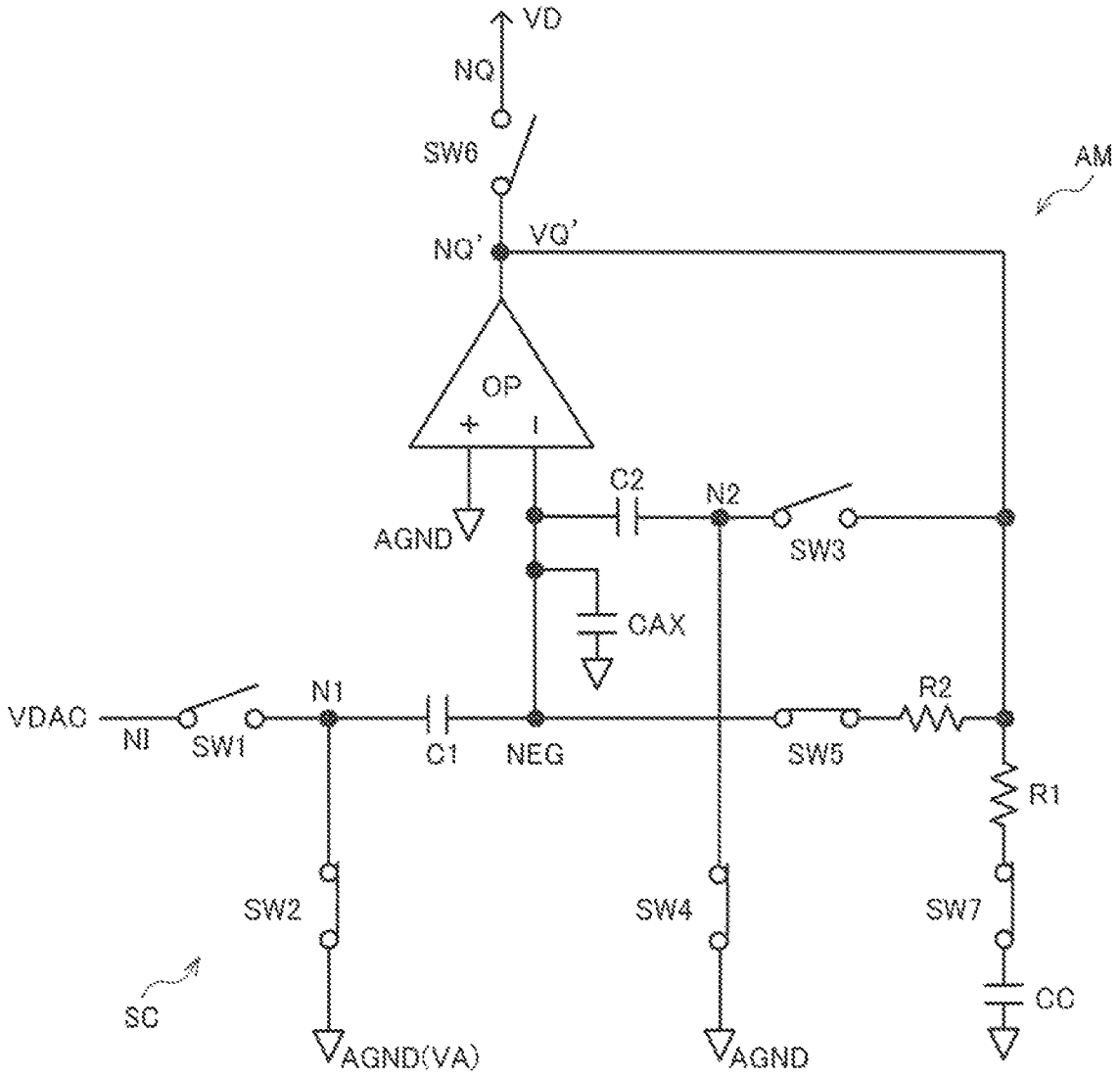
FIG. 14 is a diagram illustrating an operation in another configuration example of the amplifier circuit.
Figure 15:
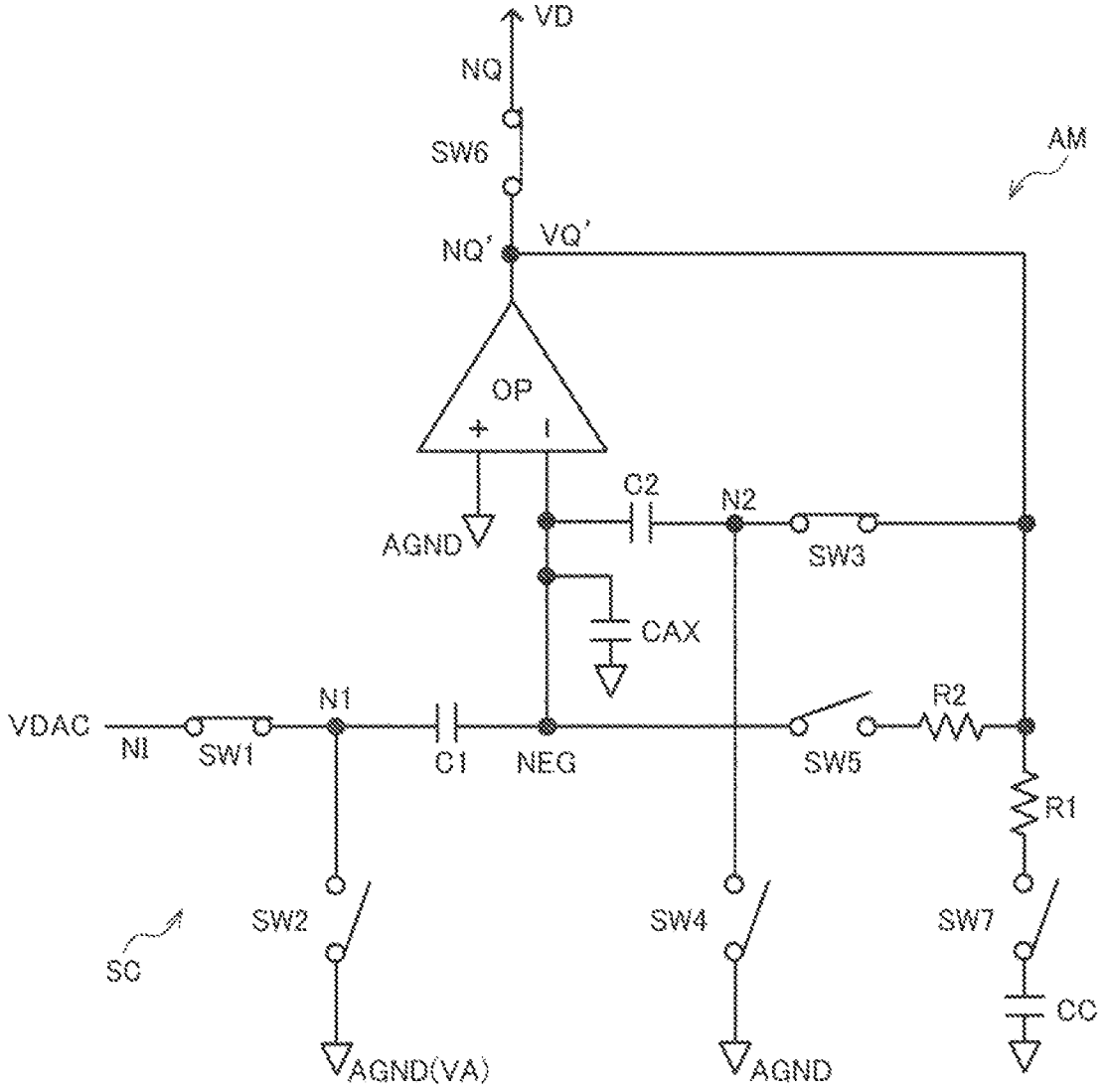
FIG. 15 is a diagram illustrating an operation in another configuration example of the amplifier circuit.

The configuration of each of the first amplifier circuit 41 and the second amplifier circuit 42 according to the present embodiment is not limited to the configuration described with reference to FIGS. 9 to 12, and various modifications can be made. For example, FIGS. 14 and 15 show other configuration examples of the amplifier circuit AM. The amplifier circuit AM shown in FIGS. 14 and 15 includes an operational amplifier OP, and a switched capacitor circuit SC including capacitors C1, C2, and CC and switches SW1 to SW7. As shown in FIG. 14, in the initialization period, the switches SW2, SW4, and SW7 are turned on, and an initialization operation for initializing, for example, charges of the capacitors C1, C2, and CC is performed. For example, in the capacitors C1, C2, and CC, a voltage AGND, which is the reference voltage, is set to one end or the other end to initialize the charges. As shown in FIG. 15, in the output period, the switches SW3 and SW6 are turned on. Accordingly, the amplifier circuit AM amplifies the output voltage VDAC of the upstream D/A conversion circuit based on the charges of the capacitors C1, C2, and CC of the switched capacitor circuit SC, and outputs the data voltage VD. For example, when the voltage AGND is set to VA, the amplifier circuit AM outputs the data voltage VD represented by VD=VA−(C1/C2)×(VDAC−VA). According to the amplifier circuit AM having the configurations shown in FIGS. 14 and 15, it is possible to implement an offset-free state in which the offset voltage of the operational amplifier OP is cancelled.

As described above, a display driver according to the present embodiment includes a line latch circuit configured to latch display data of one line, a first D/A conversion circuit configured to perform D/A conversion on the display data from the line latch circuit, and a second D/A conversion circuit configured to perform D/A conversion on the display data from the line latch circuit. The display driver further includes a first amplifier circuit which includes a first switched capacitor circuit and a first operational amplifier, and in which in a first initialization period, charges of a capacitor of the first switched capacitor circuit are initialized, and in a first output period, the first operational amplifier amplifies an output voltage of the first D/A conversion circuit based on the charges of the capacitor of the first switched capacitor circuit to output a data voltage. The display driver further includes a second amplifier circuit which includes a second switched capacitor circuit and a second operational amplifier, and in which in a second initialization period, charges of a capacitor of the second switched capacitor circuit are initialized, and in a second output period, the second operational amplifier amplifies an output voltage of the second D/A conversion circuit based on the charges of the capacitor of the second switched capacitor circuit to output a data voltage. The display driver further includes a control circuit configured to control the line latch circuit, the first amplifier circuit, and the second amplifier circuit. The control circuit is configured to end the second initialization period of the second amplifier circuit before the display data is latched by the line latch circuit at a latch timing and an output of the first amplifier circuit changes.

According to the present embodiment, the display data from the line latch circuit is subjected to D/A conversion by the first D/A conversion circuit and the second D/A conversion circuit. The charges of the capacitor of the first switched capacitor circuit are initialized in the first initialization period, the data voltage is output from the first amplifier circuit in the first output period, the charges of the capacitor of the second switched capacitor circuit are initialized in the second initialization period, and the data voltage is output from the second amplifier circuit in the second output period. Before the display data is latched by the line latch circuit at the latch timing, the second initialization period of the second amplifier circuit is controlled to be ended. Thus, it is possible to prevent a noise caused by the change in the output of the first amplifier circuit due to the latch of the display data in the line latch circuit from adversely affecting the initialization operation of the second amplifier circuit, and it is possible to prevent the reduction in the display quality due to the noise.

In the present embodiment, the display driver may include a power supply circuit including a switching regulator and configured to supply power supply voltages to the first amplifier circuit and the second amplifier circuit, and the control circuit may stop an operation of the switching regulator at least in the second initialization period.

Thus, it is possible to prevent a noise caused by a switching regulation operation of the switching regulator from adversely affecting the initialization operation of the second amplifier circuit in the second initialization period, and it is possible to prevent the reduction in the display quality due to the noise.

In the present embodiment, the first amplifier circuit may be a positive amplifier circuit configured to output a positive voltage, and the second amplifier circuit may be a negative amplifier circuit configured to output a negative voltage.

Thus, inversion driving of the display driver can be implemented by positive driving of the positive amplifier circuit and negative driving of the negative amplifier circuit.

In the present embodiment, the control circuit may alternately perform, for each horizontal scanning period, the initialization operation of the first amplifier circuit in the first initialization period and the initialization operation of the second amplifier circuit in the second initialization period.

Thus, it is possible to prevent a defect that occurs when the initialization operations of both the first amplifier circuit and the second amplifier circuit are performed in the same initialization period.

In the present embodiment, the control circuit may perform the initialization operation of the second amplifier circuit in the second initialization period after a gate line selection period in a first horizontal scanning period, and end the second initialization period of the second amplifier circuit before the display data is latched by the line latch circuit at a latch timing and the output of the first amplifier circuit changes. The control circuit may perform the initialization operation of the first amplifier circuit in the first initialization period after a gate line selection period in a second horizontal scanning period, and end the first initialization period of the first amplifier circuit before the display data is latched by the line latch circuit at a latch timing and an output of the second amplifier circuit changes.

Thus, it is possible to prevent a noise caused by the change in the output of the first amplifier circuit due to the latch of the display data from adversely affecting the initialization operation of the second amplifier circuit, and it is possible to prevent a noise caused by the change in the output of the second amplifier circuit due to the latch of the display data from adversely affecting the initialization operation of the first amplifier circuit.

In the present embodiment, the control circuit may end the second initialization period before a scanning period is switched from a first horizontal scanning period to a second horizontal scanning period, and may cause the line latch circuit to perform the latch operation in the second horizontal scanning period after the scanning period is switched from the first horizontal scanning period to the second horizontal scanning period.

Thus, the latch operation of the line latch circuit can be ended as soon as possible, the data voltage can be written to a pixel in a subsequent second gate line selection period or the like, and a writing time of the data voltage can be lengthened.

In the present embodiment, the capacitors of the first switched capacitor circuit and the second switched capacitor circuit may be capacitors to be initialized by application of a reference voltage.

Thus, the charges accumulated in the capacitor can be initialized using the reference voltage, and in the output period, an appropriate data voltage set based on the charges accumulated in the capacitor in the initialization period can be output.

Although the present embodiment has been described in detail above, it will be easily understood by those skilled in the art that many modifications can be made without substantially departing from the novel matters and effects of the present disclosure. Therefore, such modifications are intended to be included within the scope of the present disclosure. For example, a term described at least once together with a different term having a broader meaning or the same meaning in the description or the drawings can be replaced with a different term in any place in the description or the drawings. The configurations and operations of the display driver, the electro-optical device, and the like are not limited to those described in the present embodiment, and various modifications can be made.

What is claimed is:

1. A display driver, comprising:

a line latch circuit configured to latch display data of one line;

a first D/A conversion circuit configured to perform D/A conversion on the display data from the line latch circuit;

a second D/A conversion circuit configured to perform D/A conversion on the display data from the line latch circuit;

a first amplifier circuit which includes a first switched capacitor circuit and a first operational amplifier, and in which in a first initialization period, charges of a capacitor of the first switched capacitor circuit are initialized, and in a first output period, the first operational amplifier amplifies an output voltage of the first D/A conversion circuit based on the charges of the capacitor of the first switched capacitor circuit to output a data voltage;

a second amplifier circuit which includes a second switched capacitor circuit and a second operational amplifier, and in which in a second initialization period, charges of a capacitor of the second switched capacitor circuit are initialized, and in a second output period, the second operational amplifier amplifies an output voltage of the second D/A conversion circuit based on the charges of the capacitor of the second switched capacitor circuit to output a data voltage; and a control circuit configured to control the line latch circuit, the first amplifier circuit, and the second amplifier circuit, wherein the control circuit is configured to end the second initialization period of the second amplifier circuit before the display data is latched by the line latch circuit at a latch timing and an output of the first amplifier circuit changes.

2. The display driver according to claim 1, further comprising:

a power supply circuit including a switching regulator and configured to supply power supply voltages to the first amplifier circuit and the second amplifier circuit, wherein the control circuit is configured to stop an operation of the switching regulator at least in the second initialization period.

3. The display driver according to claim 1, wherein the first amplifier circuit is a positive amplifier circuit configured to output a positive voltage, and the second amplifier circuit is a negative amplifier circuit configured to output a negative voltage.

4. The display driver according to claim 1, wherein the control circuit is configured to alternately perform, for each horizontal scanning period, the initialization operation of the first amplifier circuit in the first initialization period and the initialization operation of the second amplifier circuit in the second initialization period.

5. The display driver according to claim 1, wherein the control circuit is configured to perform the initialization operation of the second amplifier circuit in the second initialization period after a gate line selection period in a first horizontal scanning period, end the second initialization period of the second amplifier circuit before the display data is latched by the line latch circuit at a latch timing and the output of the first amplifier circuit changes, perform the initialization operation of the first amplifier circuit in the first initialization period after a gate line selection period in a second horizontal scanning period, and end the first initialization period of the first amplifier circuit before the display data is latched by the line latch circuit at a latch timing and an output of the second amplifier circuit changes.

6. The display driver according to claim 1, wherein the control circuit is configured to end the second initialization period before a scanning period is switched from a first horizontal scanning period to a second horizontal scanning period, and cause the line latch circuit to perform the latch operation in the second horizontal scanning period after the scanning period is switched from the first horizontal scanning period to the second horizontal scanning period.

7. The display driver according to claim 1, wherein the capacitors of the first switched capacitor circuit and the second switched capacitor circuit are capacitors to be initialized by application of a reference voltage.

* * * * *